US010955770B1

(12) United States Patent
Kojima et al.

(10) Patent No.: US 10,955,770 B1
(45) Date of Patent: Mar. 23, 2021

(54) IMAGE FORMING APPARATUS

(71) Applicant: FUJI XEROX CO., LTD., Tokyo (JP)

(72) Inventors: Noriaki Kojima, Kanagawa (JP); Yuichi Omori, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/779,836

(22) Filed: Feb. 3, 2020

(30) Foreign Application Priority Data

Sep. 5, 2019 (JP) ..... JP2019-161665

(51) Int. Cl.
*G03G 15/16* (2006.01)

(52) U.S. Cl.
CPC ..... *G03G 15/161* (2013.01)

(58) Field of Classification Search
CPC .... G03G 15/16; G03G 15/161; G03G 15/657; G03G 15/1605
See application file for complete search history.

(56) References Cited

U.S. PATENT DOCUMENTS

2018/0231905 A1* 8/2018 Tsukamura ..... G03G 15/167

FOREIGN PATENT DOCUMENTS

JP 11-219035 A 8/1999
JP 4687642 B2 5/2011

* cited by examiner

*Primary Examiner* — Thomas S Giampaolo, II
(74) *Attorney, Agent, or Firm* — Sughrue Mion, PLLC

(57) ABSTRACT

An image forming apparatus includes: an image carrying unit that carries an image to be transferred to a sheet which is brought into contact with the image carrying unit and passed through; a separation unit that separates the sheet from the image carrying unit; and a removal unit that comes into contact with the image carrying unit, and removes toner remaining after the sheet passes through the separation unit. A non-transferred toner image that is not transferred to the sheet is formed in a range, where the separation unit is not present, of the image carrying unit.

18 Claims, 17 Drawing Sheets

IMAGE FORMING APPARATUS

CROSS-REFERENCE TO RELATED APPLICATIONS

This application is based on and claims priority under 35 USC 119 from Japanese Patent Application No. 2019-161665 filed on Sep. 5, 2019.

BACKGROUND

(i) Technical Field

The present disclosure relates to an image forming apparatus.

(ii) Related Art

What is disclosed in Japanese Patent No. 4687642 and Japanese Unexamined Patent Application Publication No. 11-219035 is known as conventional techniques that cope with a problem which may occur due to a separation unit that separates a sheet of paper from an image carrying unit such as a photoreceptor.

Japanese Patent No. 4687642 describes an image forming apparatus including a separation unit that separates a recording medium from the surface of a photoreceptor drum and guides the recording medium in a transport direction. The separation unit includes a separation claw in contact with the photoreceptor drum, and an auxiliary claw disposed on both sides of the separation claw and not in contact with the photoreceptor drum. The auxiliary claw guides the transport of the recording medium separated by the separation claw so that the recording medium does not come into contact with the back of the separation claw, and the auxiliary claw is fitted from the above after the separation claw is mounted to a mounting position.

Japanese Unexamined Patent Application Publication No. 11-219035 describes a separation device of an image forming apparatus in which a toner image formed on the surface of an image carrier is transferred to a sheet of paper, and part of a claw-like separation member is brought into contact with the surface of the image carrier to separate the sheet absorbed in the surface of the image carrier, where the separation device has a shape which allows the separation device to pass through a contact portion between the claw-like separation member and the image carrier. Japanese Unexamined Patent Application Publication No. 11-219035 describes that the part of the claw-like separation member is brought into contact with the surface of the image carrier with a width in an axial direction, and an introduction surface is formed on the leading end side of the contact portion between the separation member and the image carrier, the introduction surface being configured to allow remaining toner adhering on the image carrier to pass through the contact portion without being blocked by the contact portion.

SUMMARY

Aspects of non-limiting embodiments of the present disclosure relate to an image forming apparatus that can reduce adherence of part of the toner in a non-transferred toner image formed in an image carrying unit to a portion, where a sheet of paper passes through, of a separation unit that separates a sheet of paper from the image carrying unit, as compared with when the non-transferred toner image is similarly formed in a range of the image carrying unit, where the separation unit is present.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image carrying unit that carries an image to be transferred to a sheet which is brought into contact with the image carrying unit and passed through; a separation unit that separates the sheet from the image carrying unit; and a removal unit that comes into contact with the image carrying unit, and removes toner remaining after the sheet passes through the separation unit. A non-transferred toner image that is not transferred to the sheet is formed in a range, where the separation unit is not present, of the image carrying unit.

BRIEF DESCRIPTION OF THE DRAWINGS

Exemplary embodiments of the present disclosure will be described in detail based on the following figures, wherein.

DETAILED DESCRIPTION

Hereinafter exemplary embodiments of the disclosure will be described with reference to the drawings.

First Exemplary Embodiment

Figure 1:
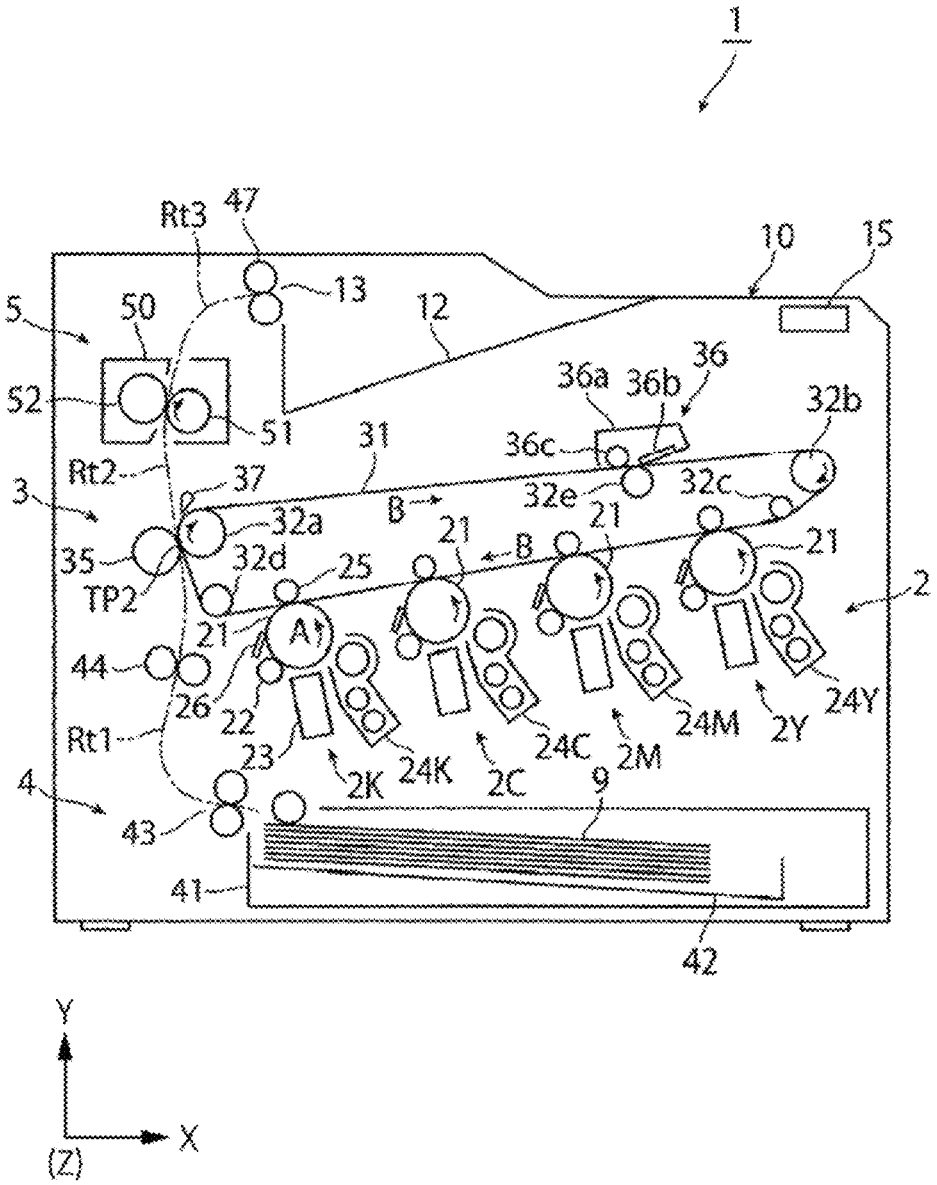
FIG. 1 is a schematic view illustrating the entirety of an image forming apparatus according to a first exemplary embodiment.
Figure 2:
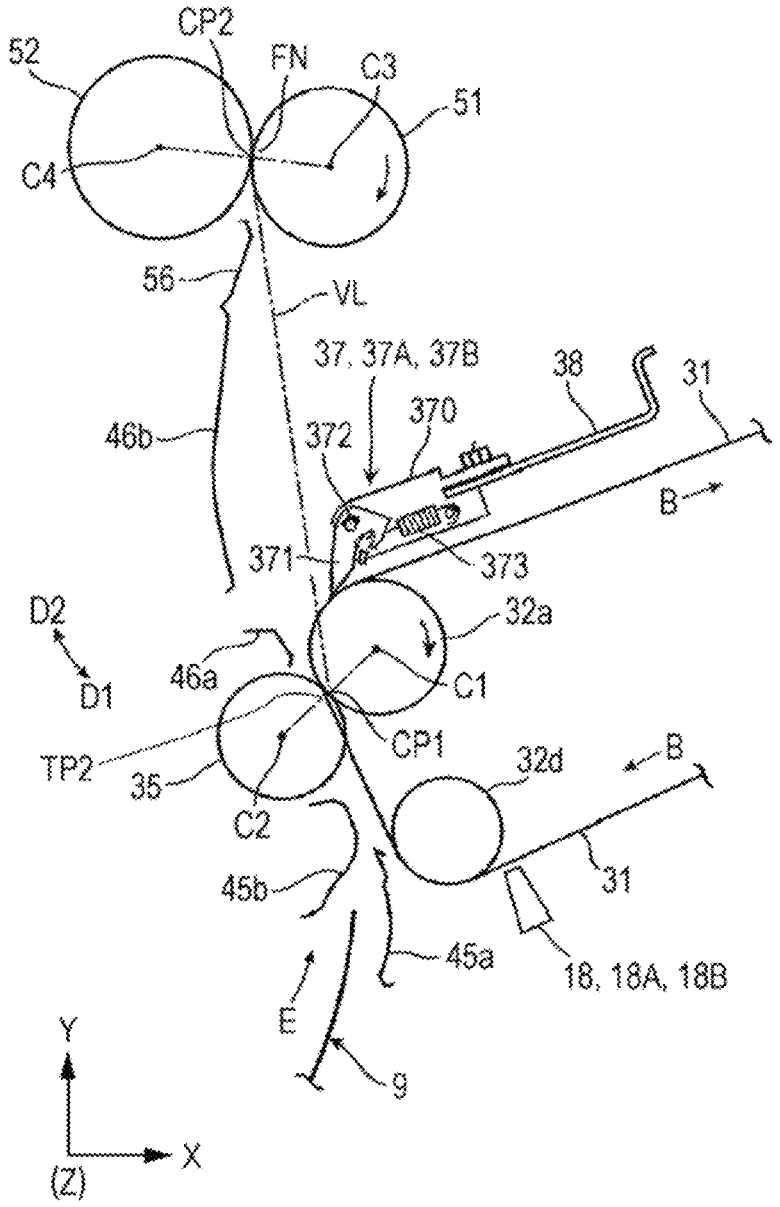
FIG. 2 is a schematic view illustrating part of the image forming apparatus of FIG. 1.

FIGS. 1 and 2 illustrate an image forming apparatus 1 according to a first exemplary embodiment. FIG. 1 illustrates the entire configuration of the image forming apparatus 1, and FIG. 2 illustrates part (primarily, the second transfer position and its surrounding area) of the configuration of the image forming apparatus 1.

The arrows labeled with the symbols X, Y, Z in the drawings such as FIG. 1, FIG. 2 indicate the directions of width, height, and depth of three-dimensional space defined in the drawings. In each of the drawings, a circle symbol at the intersection of the arrows in the X and Y directions indicates that the Z direction is toward the vertical downward of the drawing surface.

The image forming apparatus 1 is an apparatus that forms an image composed of toner as a developer on a sheet of paper 9 which is an example of a recording medium. The image forming apparatus 1 in the first exemplary embodiment is implemented as a printer that forms an image corresponding to image information inputted from an external connection device such as an information terminal device, for instance.

As illustrated in FIG. 1, in the internal space of a housing 10, the image forming apparatus 1 includes an image forming device 2 that forms a toner image based on image information; an intermediate transfer device 3 that temporarily holds the image formed by the image forming device 2 then secondarily transfers the image to the sheet of paper 9; a sheet feeding device 4 that stores and supplies sheets of paper 9 to be supplied to the position at which secondary transfer is performed by the intermediate transfer device 3; a fixing device 5 that fixes a toner image secondarily transferred by the intermediate transfer device 3 to the sheet of paper 9; and a control unit 15 that performs control related to the operations of the devices mentioned above.

The image information is information on an image such as a character, a figure, a photograph, and a pattern, for instance. The housing 10 is a structure formed in a desired shape with various support members and exterior materials. Part of the upper surface of the housing 10 includes a discharge storage 12 that stores sheets of paper 9 in a stacked state, which are discharged after an image is formed; and a discharge port 13 through which the sheet of paper 9 is discharged to the discharge storage 12. The dashed-dotted line of FIG. 1 and other figures indicates a primary transport path when the sheet of paper 9 is transported within the housing 10.

The image forming device 2 includes four image forming devices 2Y, 2M, 2C, and 2K that exclusively form toner images of four colors: yellow (Y), magenta (M), cyan (C), and black (K), respectively.

Each of the four image forming devices 2 (Y, M, C, K) has a photoreceptor drum 21 which is an example of an image carrying unit that rotates in the direction indicated by an arrow A, and the image forming device 2 is formed by disposing devices, such as a charging device 22, an exposure device 23, a developing device 24 (Y, M, C, K), a first transfer device 25, and a drum cleaning device 26, in the surroundings of each photoreceptor drum 21. In FIG. 1, all of the symbols 21 to 26 are labeled to the image forming device 2K for black (K) only, and part of the symbols are labeled to the image forming devices (Y, M, C) for other colors.

Among all, the charging device 22 is a device that charges the outer circumferential surface (surface allowing formation of an image) of the photoreceptor drum 21 to a desired surface potential. The exposure device 23 is a device that performs light exposure on the outer circumferential surface of the photoreceptor drum 21 based on image information, and forms an electrostatic latent image having desired color components (Y, M, C, K). The developing device 24 (Y, M, C, K) is a device that develops the electrostatic latent image formed on the outer circumferential surface of the photoreceptor drum 21 with developer (toner) corresponding desired colors (Y, M, C, K), and forms a toner image. The first transfer device 25 is a device that electrostatically transfers the toner image of each color to the intermediate transfer device 3 (an intermediate transfer belt 31). The drum cleaning device 26 is an example of a removal unit that scrapes and removes unnecessary toner and unwanted substances, such as paper powder, adhering to the outer circumferential surface of the photoreceptor drum 21 to clean the outer circumferential surface of the photoreceptor drum 21.

In these image forming devices 2 (Y, M, C, K), each location where the photoreceptor drum 21 and the first transfer device 25 are opposed to each other is the first transfer position at which the first transfer of a toner image is performed.

The intermediate transfer device 3 is a device configured to carry a toner image of each color formed by the image forming devices 2 (Y, M, C, K) by the first transfer, then transport the toner image to a position at which the second transfer is performed on the sheet of paper 9. The intermediate transfer device 3 is disposed on the upper side of the image forming devices 2 (Y, M, C, K) within the housing 10, and specifically includes an intermediate transfer belt 31 which is another example of the image carrying unit to which a toner image is first transferred from each photoreceptor drum 21 of the image forming devices 2 (Y, M, C, K), and which carries the toner image. The intermediate transfer device 3 is formed by disposing the following devices in the surroundings of the intermediate transfer belt 31.

The intermediate transfer belt 31 is supported by multiple support rollers 32*a* to 32*e* disposed therewithin so as to pass through the first transfer positions of the image forming devices 2 (Y, M, C, K) sequentially and rotate (circumferential movement) in the direction indicated by an arrow B.

The support roller 32*a* of the multiple support rollers 32*a* to 32*e* is formed as a drive roller and a second transfer backup roller, and the support roller 32*b* is formed as a tension roller. The support rollers 32*c*, 32*d* are formed as surface rollers that holds the belt position (surface) when the first transfer positions of the intermediate transfer belt 31 are passed, and the support roller 32*e* is formed as a cleaning backup roller of the later-described belt cleaning device (36). The support roller 32*e* is formed as a cleaning backup roller for the later-described belt cleaning device 36.

The support rollers 32*a* to 32*e* are rotatably provided in a support frame (not illustrated) of the intermediate transfer device 3.

The first transfer device 25 of each of the image forming devices 2 (Y, M, C, K) is disposed inwardly of the intermediate transfer device 3. The first transfer device 25 is included as part of the intermediate transfer device 3, and the intermediate transfer belt 31 is pressed against the photoreceptor drum 21 by a first transfer member, in a roll form or the like, to which a first transfer current is supplied.

A second transfer device 35 is disposed at the outer circumferential surface portion supported by the support roller 32*a* of the intermediate transfer belt 31. The second transfer device 35 allows the sheet of paper 9 to pass through and secondarily transfers a toner image on the intermediate transfer belt 31 to the sheet of paper 9. The second transfer device 35 is configured to allow the sheet of paper 9 to be transported in contact with and pressed against the outer circumferential surface portion of the intermediate transfer belt 31 by a second transfer member, in a roll form or the like, to which a second transfer current is supplied, the outer circumferential surface portion being supported by the support roller 32*a*.

In the intermediate transfer device 3, the location where the outer circumferential surface of the intermediate transfer belt 31 is in contact with the second transfer device 35 is a second transfer position TP2 at which the second transfer of a toner image is performed.

In the surroundings of the outer side of the intermediate transfer belt 31, a belt cleaning device 36 is disposed, which is another example of a removal unit that removes unwanted substances such as unnecessary toner adhering to the outer circumferential surface of the intermediate transfer belt 31 to clean the outer circumferential surface of the intermediate transfer belt 31.

Figure 5:
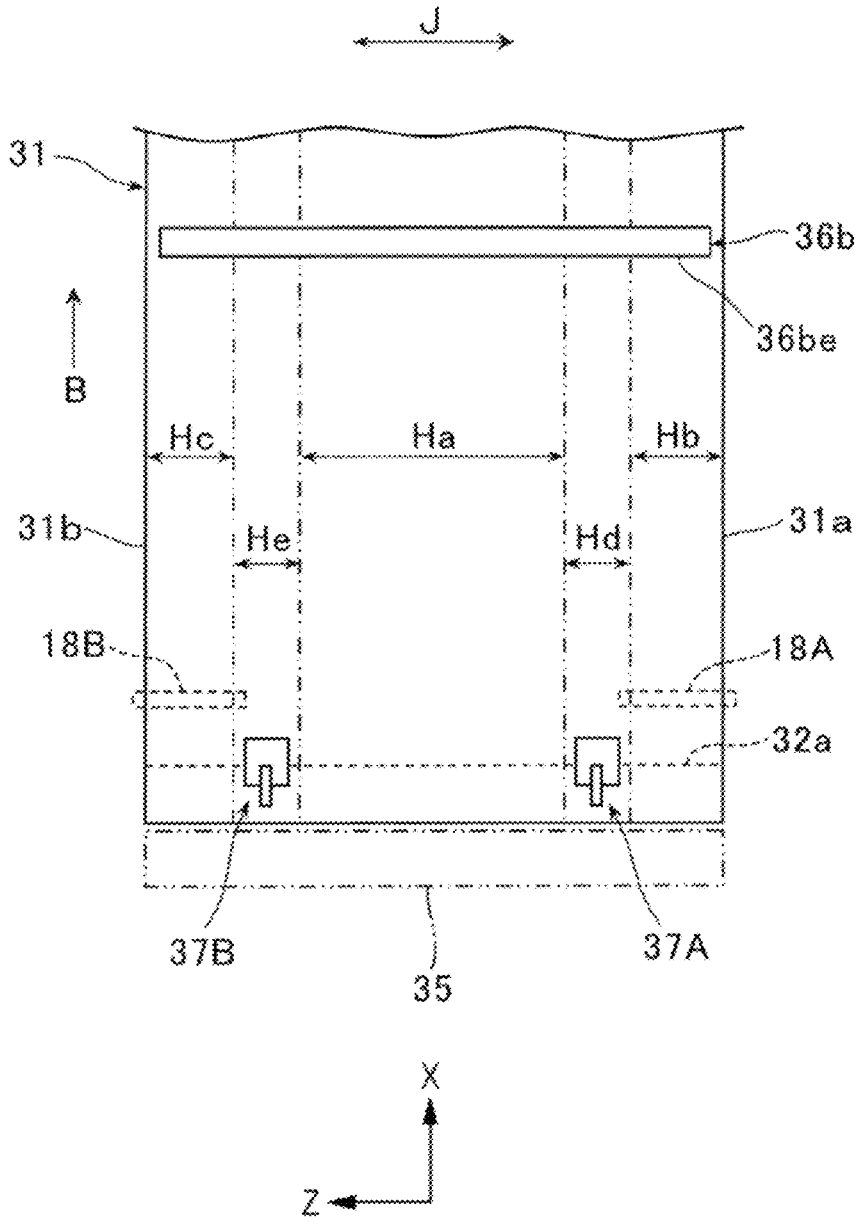
FIG. 5 is a schematic view illustrating the configuration of ranges in the outer circumferential surface of an intermediate transfer belt.

The belt cleaning device 36 is formed by disposing inside a housing 36*a*, a plate-like cleaning member 36*b* that removes unwanted substances by being in contact with the outer circumferential surface of the portion supported by the roller 32*e* of the intermediate transfer belt 31, and a collecting member 36*c* that rotates and collects the unwanted substances removed by the cleaning member 36*b*. In the belt cleaning device 36, as illustrated in FIGS. 1 and 5, the cleaning member 36*b* is disposed in a rotational direction B of the intermediate transfer belt 31 so as to be in contact with the intermediate transfer belt 31 in a width direction (or an axial direction) J substantially perpendicular to the rotational direction B of the intermediate transfer belt 31 at a position on the path from the support roller 32*a* to the support roller 32*b*.

In addition, in the surroundings of the outer side of the intermediate transfer belt 31, a separation device 37 is disposed, which is an example of a separation unit that separates the sheet of paper 9 after the second transfer from the outer circumferential surface of the intermediate transfer belt 31.

Figure 3:
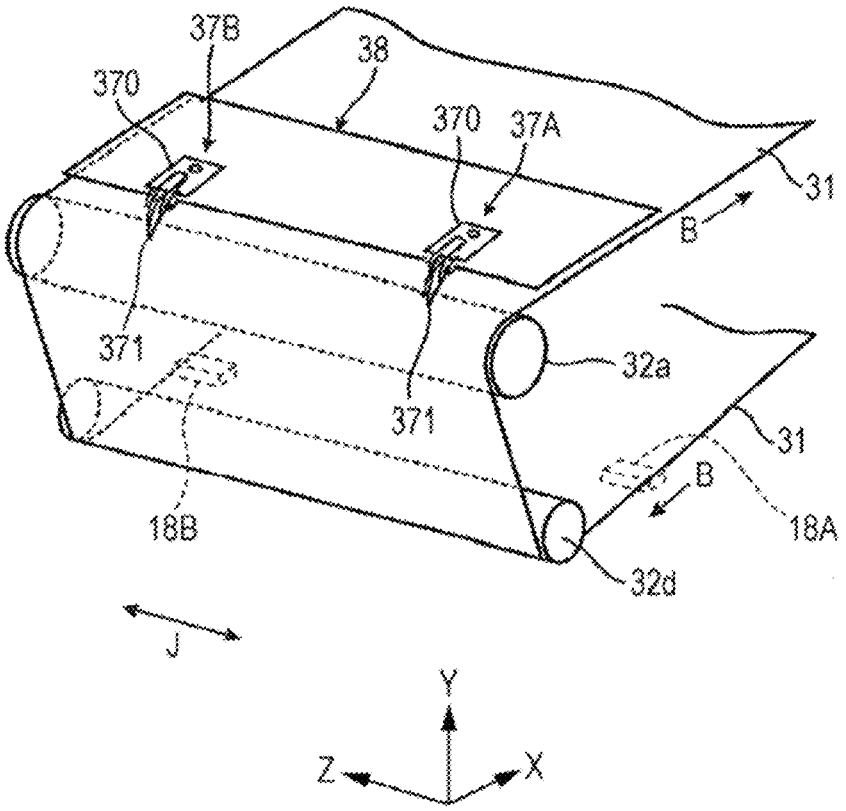
FIG. 3 is a schematic perspective view illustrating another part of the image forming apparatus of FIG. 1.

As illustrated in FIG. 3, the separation device 37 is disposed as two separation devices 37A, 37B with a desired interval in the width direction J of the intermediate transfer belt 31. As illustrated in FIG. 3, each of the separation devices 37A, 37B includes a separation claw 371 having a tapered leading end, mounted on a fixing frame 370 as a support unit swingably in the directions indicated by arrows D1, D2 with a support shaft 372 serving as a fulcrum; and an elastic member 373, such as a coil spring, which urges the separation claw 371 in the direction indicated by the arrow D1 so that a leading end 371*a* of the separation claw 371 elastically comes into contact with the outer circumferential surface of the intermediate transfer belt 31. As illustrated in FIG. 3, these two separation devices 37A, 37B are mounted so as to be disposed at predetermined positions of a mounting plate 38. The mounting plate 38 is fixed to, for instance, a support frame (not illustrated) of the intermediate transfer device 3.

The sheet feeding device 4 is a device configured to store and supply the sheets of paper 9 to be supplied to the second transfer position TP2 of the intermediate transfer device 3. The sheet feeding device 4 is disposed at a position on the lower side of the image forming devices 2 (Y, M, C, K) inside the housing 10, and is formed by disposing specifically devices such as a storage body 41 of sheets of paper, and a feeding device 43.

The storage body 41 is a storage member having a stacking plate 42 for storing multiple sheets of paper 9 stacked in a desired orientation, and is mounted to allow an operation such as drawing the storage member to the outside of the housing 10 and loading the sheets of paper 9. The feeding device 43 is a device that delivers the uppermost one of the sheets of paper 9 stacked on the stacking plate 42 of the storage body 41 one by one by sheet delivery devices such as multiple rollers. The sheet of paper 9 may be a recording medium, such as regular paper, coated paper, or thick paper, which can be transported within the housing 10 of the image forming apparatus 1, and allows transfer and fixing of a toner image, and the quality and form of the recording medium is not particularly restricted.

The fixing device 5 is a device configured to fix a toner image to the sheet of paper 9, the toner image being secondarily transferred by the intermediate transfer device 3. The fixing device 5 is disposed at a position on the upper side of the second transfer position TP2 of the intermediate transfer device 3 within the housing 10, and is formed by disposing specifically devices, such as a rotational body 51 for heating, and a rotational body 52 for pressurizing, in the internal space of the housing 10 provided with an introduction port and a discharge port for the sheets of paper 9.

The rotational body 51 for heating is a rotational body in a roll form or a belt-pad form rotatable in the direction indicated by an arrow, and is heated so that the outer circumferential surface is maintained at a desired temperature by a heating unit which is not illustrated. The rotational body 52 for pressurizing is a rotational body in a roll form or a belt-pad form, which comes into contact with the rotational body 51 to be driven and rotate under a desired pressure. The rotational body 52 for pressurizing may be heated by a heating unit.

In the fixing device 5, the location where the rotational body 51 for heating and the rotational body 52 for pressurizing are in contact with each other serves as a nip part (fixing processor) FN that performs processing such as heating, pressurizing for fixing an unfixed toner image to the sheet of paper 9.

In the image forming apparatus 1, as illustrated in FIG. 1, a sheet feeding transport path Rt1 for transporting and supplying the sheet of paper 9 at the sheet feeding device 4 to the second transfer position TP2 is provided between the sheet feeding device 4 and the second transfer position TP2 of the intermediate transfer device 3. As illustrated in FIGS. 1 and 2, the sheet feeding transport path Rt1 is formed by disposing a pair of transport rollers 44 that sandwich and transport the sheet of paper 9, and multiple guiding members 45*a*, 45*b* that ensure the transport space for the sheet of paper 9 and guide the transport of the sheet of paper 9. Among these, the transport rollers 44 are formed as delivery rollers, so-called registration rollers that correct skew of the sheet of paper 9 and deliver the sheet of paper 9 at a desired timing synchronized with the second transfer.

In the image forming apparatus 1, as illustrated in FIGS. 1 and 2, an introduction transport path Rt2 is provided between the second transfer position TP2 of the intermediate transfer device 3 and the nip part FN of the fixing device 5 for introducing the sheet of paper 9 after the second transfer to the nip part FN. As illustrated in FIG. 2, the introduction transport path Rt2 is formed by disposing multiple guiding members 46*a*, 46*b*, 56 that ensure the transport space for the sheet of paper 9 and guide the transport of the sheet of paper 9. Among these, the guiding member 56 is a guiding member for introduction provided at an introduction port of a housing 50 of the fixing device 5.

A dashed-dotted line VL illustrated in FIG. 2 and other figures indicates an ideal transport path for the sheet of paper 9 in the introduction transport path Rt2. The dashed-dotted line VL is an ideal line obtained by connecting a point CP1 and a point CP2, the point CP1 being an intersection point at which the nip part of the second transfer position TP2 intersects the line obtained by connecting a rotational center C1 of the support roller 32*e* of the intermediate transfer belt 31 and a rotational center C2 of the roll-shaped second transfer member of the second transfer device 35, the point CP2 being an intersection point at which the nip part FN intersects the line obtained by connecting a rotational center C3 of the rotational body 51 for heating and a rotational center C4 of the rotational body 52 for pressurizing in the fixing device 5.

In addition, in the image forming apparatus 1, as illustrated in FIG. 1, a discharge transport path Rt3 for transporting the sheet of paper 9 after fixing completed to the discharge port 13 and discharging the sheet of paper 9 to the discharge storage 12 is provided between the fixing device 5 and the discharge port 13. The discharge transport path Rt3 is formed by disposing a pair of discharge rollers 47 in front of the discharge port 13, and a guiding member (not illustrated) that ensures the transport space for the sheet of paper 9 and guides the transport of the sheet of paper 9.

The control unit 15 includes, for instance, an arithmetic processing device, memory element and device, an I/O device, and a control device for those devices.

Figure 4:
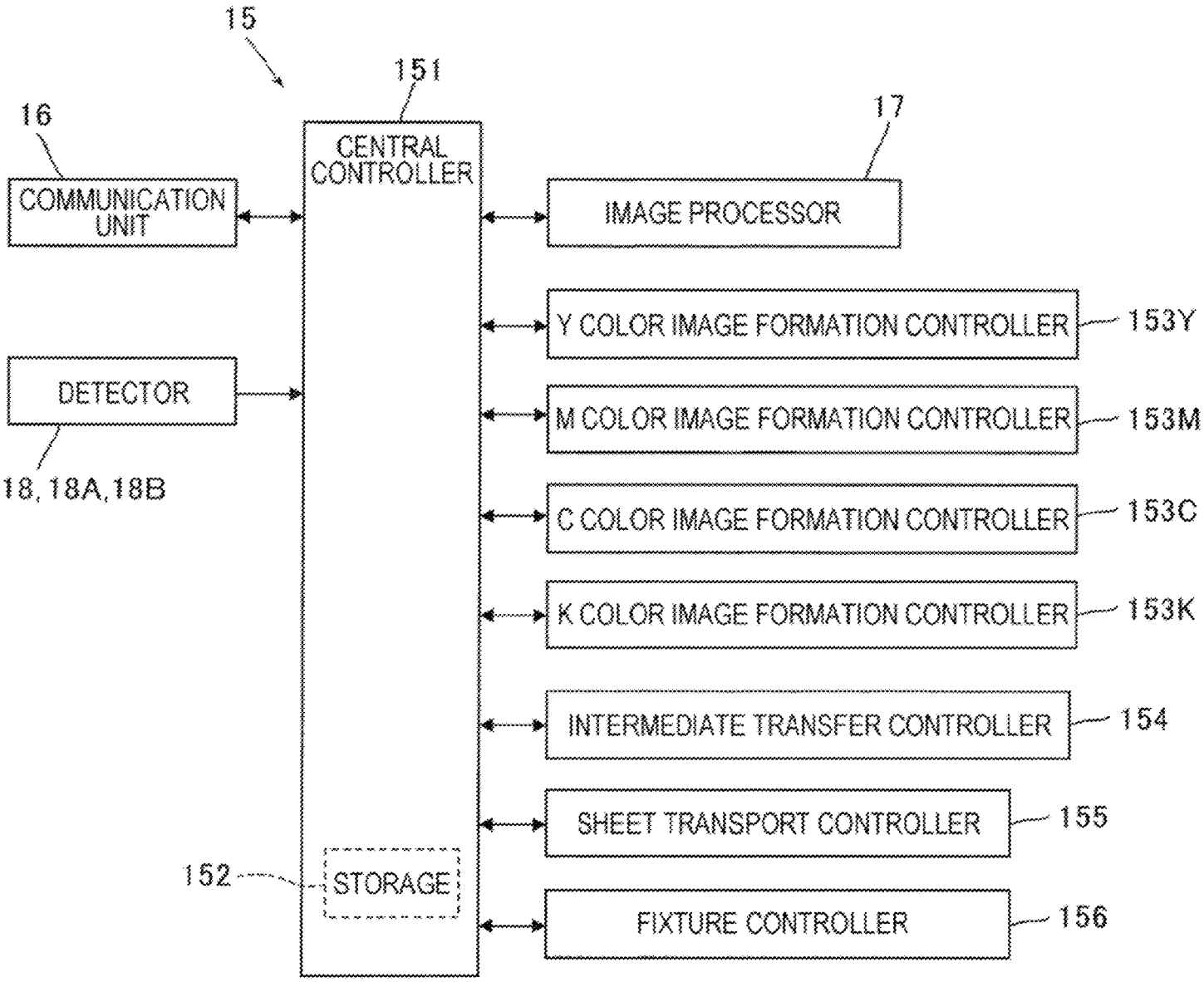
FIG. 4 is a block diagram illustrating the configuration of a control unit in the image forming apparatus of FIG. 1.

As illustrated in FIG. 4, the control unit 15 includes a central controller 151 that integrates and controls the entire operations of the image forming apparatus 1; image forming controllers 153Y, 153M, 153C, 153K that control the operations of the image forming devices 2 (Y, M, C, K) of the four colors (Y, M, C, K); an intermediate transfer controller 154 that controls the operations of the intermediate transfer device 3; a sheet transport controller 155 that controls the operations of the sheet feeding device 4, the sheet feeding transport path Rt1, and the discharge transport path Rt3; and a fixture controller 156 that controls the operations of the fixing device 5. Among these, the central controller 151 has a memory 152 including the above-mentioned memory element and device that store a control program for the entire control of the image forming apparatus 1 and information such as data necessary for the control. The other controllers 153 to 156 also have respective memories that store necessary control program and data.

As illustrated in FIG. 4, the control unit 15 is connected to a communication unit 16 that exchanges information with an external connection device or the like by a desired communication unit, an image processor 17 that performs necessary processing on image information inputted to the image forming apparatus 1 from the external connection device, and a detector 18 that detects an operation and a state within the image forming apparatus 1. The control unit 15 is configured to input and output necessary information (signals) to and from those targets to be connected.

Furthermore, in the image forming apparatus 1, a non-transferred toner image NT, which is not transferred to the sheet of paper 9, is formed by the image forming device 2.

The non-transferred toner image NT is formed as a toner image in a predetermined pattern on the photoreceptor drum 21 by each relevant image forming device 2 (Y, M, C, K), then is first transferred to the intermediate transfer belt 31 of the intermediate transfer device 3 under normal transfer conditions. Subsequently, the non-transferred toner image NT is passed through the second transfer position TP2 under conditions which cause no transfer effect by the second transfer device 35. Consequently, the non-transferred toner image NT does not come into contact with the intermediate transfer belt 31 at the second transfer position TP2 and is not secondarily transferred to the sheet of paper 9. The non-transferred toner image NT which passes through the second transfer position TP2 is finally removed from the outer circumferential surface of the intermediate transfer belt 31 by the belt cleaning device 36 of the intermediate transfer device 3.

Such non-transferred toner image NT includes, for instance, the following images.

Figure 7:
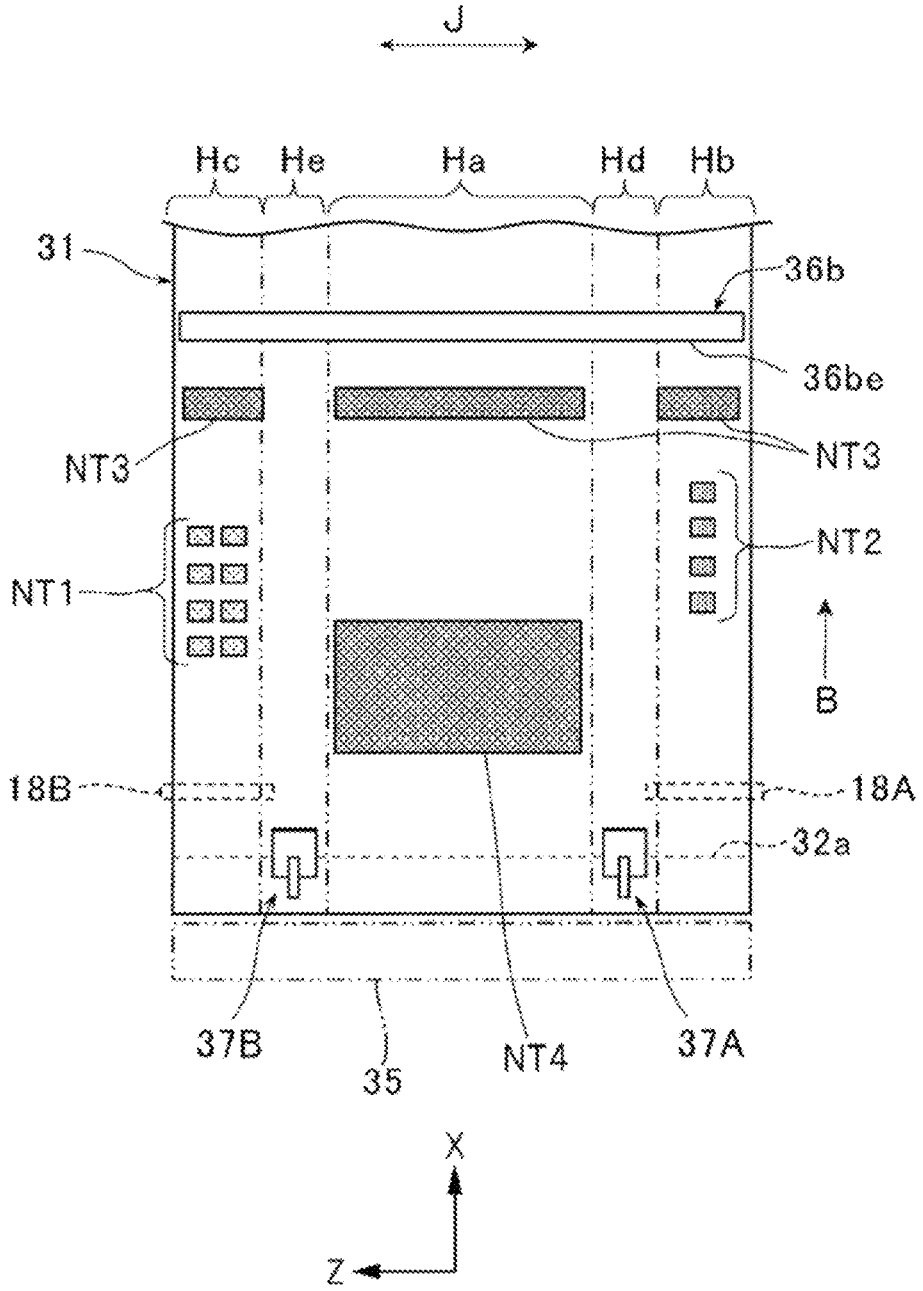
FIG. 7 is a schematic view illustrating the range where a non-transferred toner image is formed.

Specifically, the non-transferred toner image NT includes a patch image NT1 for process control formed when image formation conditions (conditions necessary for image formation, such as a concentration, and positioning) are adjusted, and a pattern image NT2 for registration control formed when misregistration of the position of a toner image formed is checked or eliminated (see FIG. 7). For the patch image NT1 for process control and the pattern image NT2 for registration control which are formed in order to obtain the control information, as illustrated in FIGS. 2 and 3, image reading sensors 18A, 18B for reading the patch image NT1 for process control and the pattern image NT2 for registration control are each disposed at a predetermined position of the intermediate transfer belt 31. The image reading sensors 18A, 18B in the first exemplary embodiment are each disposed at a position in front of where the intermediate transfer belt 31 is supported by the support roller 32*d*.

In addition, the non-transferred toner image NT includes a toner band image NT3 which is formed to reduce the occurrence of crying noise and turn-up phenomenon of the plate-like cleaning member 36*b* of the belt cleaning device 36. Furthermore, the non-transferred toner image NT includes a discharge toner image NT4. When a predetermined amount of image including a low concentration toner image is (continuously) formed, the discharge toner image NT4 is formed to forcedly discharge deteriorated toner in the developing devices 24 (Y, M, C, K) of the image forming devices 2 by a predetermined amount.

In the image forming apparatus 1, as illustrated in FIG. 5, the non-transferred toner image NT is configured to be formed in ranges Ha, Hb, Hc of the intermediate transfer belt 31, where the separation devices 37 (37A, 37B) are not present.

In this configuration, in other words, for instance, the non-transferred toner image NT is not formed in ranges Hd, He (see FIG. 5, FIG. 7) of the intermediate transfer belt 31, where the separation devices 37 (37A, 37B) are present.

As illustrated in FIG. 5, the range Ha is an inward range between two separation devices 37A, 37B, when viewed across the width direction J of the intermediate transfer belt 31.

In contrast, the range Hb is a range on one end side (near side of the apparatus) between the separation device 37A on one side (near side of the apparatus) and a lateral end 31*a* on one side of the intermediate transfer belt 31. The range Hc is a range on the other end side (far side of the apparatus) between the separation device 37B on the other side (far side of the apparatus) and a lateral end 31*b* on the other side of the intermediate transfer belt 31.

The symbol Hd in FIG. 5 indicates the range of the intermediate transfer belt 31, where the separation device 37A is present, and the symbol He indicates the range of the intermediate transfer belt 31, where the separation device 37B is present.

The ranges Ha, Hb, Hc of the intermediate transfer belt 31, where the separation devices 37 (37A, 37B) are not present are set in the following manner, for instance.

Figure 6:
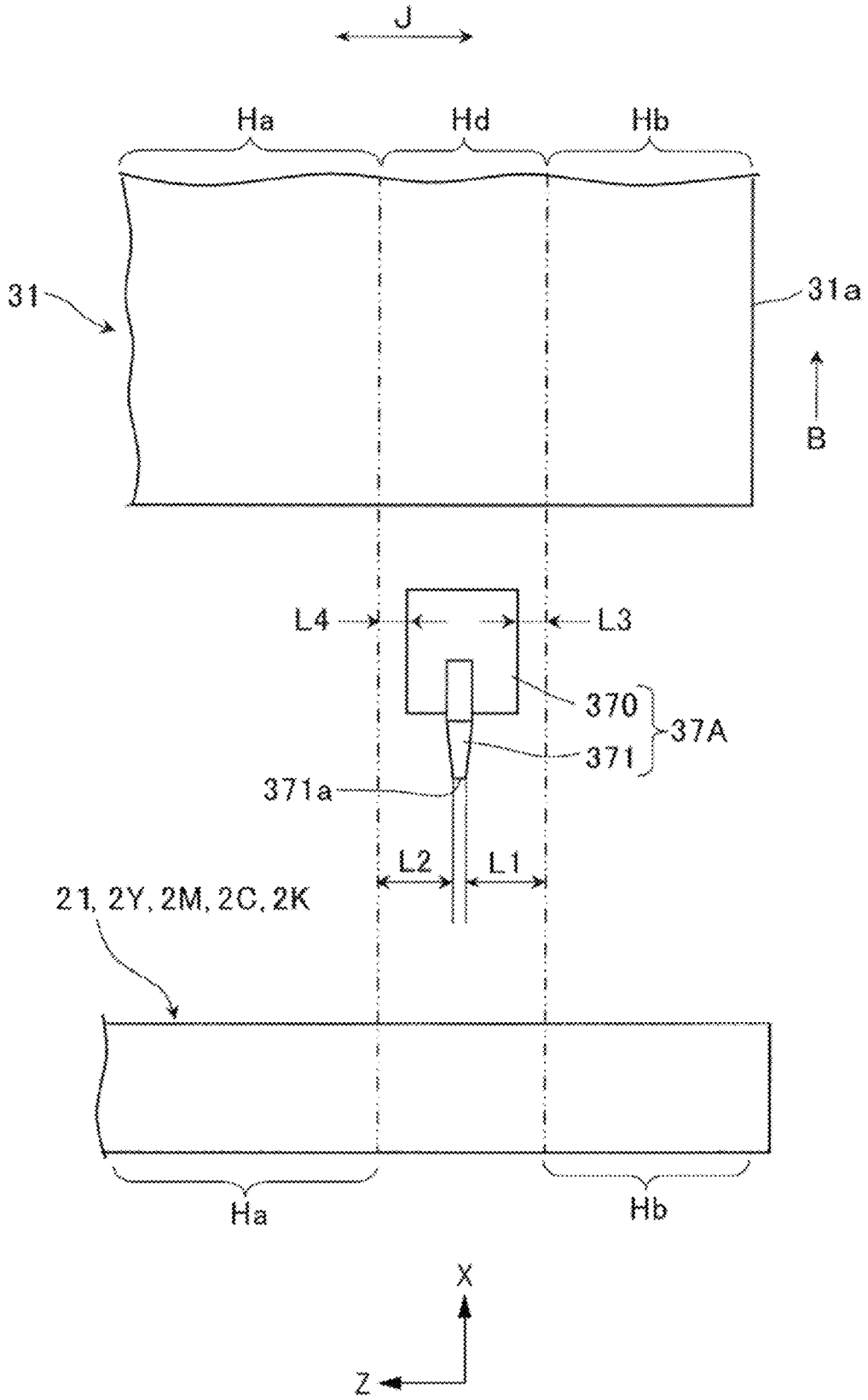
FIG. 6 is a conceptual view illustrating the configuration of the range of the intermediate transfer belt, where a separation unit is not present.

Specifically, as conceptually illustrated in FIG. 6, the ranges Ha, Hb, Hc which are divided by imaginary boundary lines (dashed-two dotted lines in FIG. 6) which pass through positions in the rotational direction B, the positions being away from a leading end 371*a* of the separation claw 371 of the separation device 37A by predetermined distances L1, L2 in the width direction J, the leading end 371*a* being in contact with the outer circumferential surface of the intermediate transfer belt 31. It is sufficient that the predetermined distances L1, L2 be effective lengths to prevent the toner of part of the non-transferred toner image NT from adhering to the separation claw 371. For instance, the distances L1, L2 are 1 to 3 cm. It is sufficient that the distances L1, L2 be the same lengths, but may be different lengths from each other. The distances L1, L2 are also set in the other separation device 37B from the same point of view.

As in the separation device 37A in the first exemplary embodiment, when the fixing frame 370 is present which indicates one range of the separation device 37A, as illustrated in FIG. 6, the ranges Ha, Hb, Hc can be set as the ranges divided by imaginary boundary lines (dashed-two dotted lines in FIG. 6) which pass through positions in the rotational direction B, the positions being away from the fixing frame 370 by predetermined distances L3, L4 in the width direction J. The distances L3 and L4 are set at will from the same point of view for the case of the distances L1, L2. The distances L3, L4 are also set in the other separation device 37B from the same point of view.

The non-transferred toner image NT formed in the ranges Ha, Hb, Hc, where the separation devices 37 (37A, 37B) are not present, of the intermediate transfer belt 31 starts to be formed by each relevant image forming device 2 (Y, M, C, K) at a predetermined time based on image information which is stored in a relevant component related to the control unit 15 in advance as patterns of positions for image formation. The relevant component includes, for instance, the memory 152 of the central processor 151, the memory of the four color image forming controllers 153, and the memory of the image processor 17.

The non-transferred toner image NT is not particularly restricted except that the range for image formation is restricted. Thus, for the non-transferred toner image NT, the conditions for concentration, formation timing, for instance, are not required to be changed particularly, and conventional conditions may be applied. However, the non-transferred toner image NT is not formed in the ranges Hd, He of the intermediate transfer belt 31, where the separation devices 37 (37A, 37B) are present, thus it is possible to adjust a formation pattern of a toner image or a toner amount to supplement the non-formation of image.

FIG. 7 illustrates a specific example of the non-transferred toner image NT which is formed in the ranges Ha, Hb, Hc of the intermediate transfer belt 31, where the separation devices 37 (37A, 37B) are not present.

For instance, the patch image NT1 for process control as the non-transferred toner image NT is formed in a predetermined pattern in the range Hc of the intermediate transfer belt 31 when control to adjust the process conditions is to be performed.

The pattern image NT2 for registration control as the non-transferred toner image NT is formed in a predetermined pattern in the range Hb of the intermediate transfer belt 31 when control to correct misregistration is to be performed.

The toner band image NT3 as the non-transferred toner image NT is formed in a pattern divided into thirds to be distributed to the ranges Ha, Hb, Hc of the intermediate transfer belt 31 at a predetermined timing. It is desirable that the toner band image NT3 be formed in all of the ranges Ha, Hb, Hc from the point of view of eliminating a problem in the belt cleaning device 36 by supplying toner to the entire area of a leading end 36*be* of the plate-like cleaning member 36*b* of the belt cleaning device 36.

At a desired timing after a low concentration image in a predetermined amount is formed, the discharge toner image NT4 as the non-transferred toner image NT is formed in a predetermined pattern in the range Ha of the intermediate transfer belt 31, for instance. Incidentally, the discharge toner image NT4 may be formed in one or both of the ranges Hb, Hc in addition to the range Ha of the intermediate transfer belt 31.

For any type of the non-transferred toner image NT, formation thereof starts in the following manner: an electrostatic latent image for the non-transferred toner image NT is formed in a desired pattern on the photoreceptor drum 21 of each relevant image forming device 2 (Y, M, C, K) by an exposure operation of the exposure device 23, then the electrostatic latent image is formed as a toner image having a predetermined concentration by a developing operation of each relevant developing device 24 (Y, M, C, K).

In this process, the electrostatic latent image for the non-transferred toner image NT is formed in the area (see FIG. 6) of the photoreceptor drum 21, corresponding to the ranges Ha, Hb, Hc of the intermediate transfer belt 31.

Subsequently, the non-transferred toner image NT formed on the photoreceptor drum 21 in each relevant image forming device 2 (Y, M, C, K) is first transferred to the ranges Ha, Hb, Hc of the intermediate transfer belt 31 of the intermediate transfer device 3 by the first transfer process of the first transfer device 25, then is transported by the intermediate transfer belt 31 that rotates in the direction indicated by the arrow B, but is passed through the second transfer position TP2 without being secondarily transferred to the sheet of paper 9 at the TP2.

In this process, in the second transfer device 35, the conditions are switched to those that do not allow the non-transferred toner image NT on the intermediate transfer belt 31 to be transferred to the second transfer device 35. Incidentally, for the patch image NT1 for process control and the pattern image NT2 for registration control of the non-transferred toner image NT, the state of image formation is read by the image reading sensors 18A, 18B. The information (signal) read by the image reading sensors 18A, 18B is transmitted to the central controller 151 in the control unit 15, and is used as the control information.

Sequentially, the non-transferred toner image NT, which has passed through the second transfer position TP2 of the intermediate transfer device 3, passes through the area (the ranges Ha, Hb, Hc) of the outer circumferential surface of the intermediate transfer belt 31, where the separation devices 37 disposed immediately after the second transfer position TP2 are not present, and is finally removed and collected from the outer circumferential surface of the intermediate transfer belt 31 by the belt cleaning device 36.

In this process, the non-transferred toner image NT on the outer circumferential surface of the intermediate transfer belt 31 does not come into contact with the leading end 371*a* of the separation claw 371 of each separation device 37, and passes through a position away from the leading end 371*a* of the separation claw 371 by at least the distances L1, L2.

Thus, in the image forming apparatus 1, when the non-transferred toner image NT is formed, as compared with when the non-transferred toner image NT is similarly formed also in the ranges Hd, He of the intermediate transfer belt 31, where the separation devices 37 (37A, 37B) are present, toner of part of the non-transferred toner image NT formed in the ranges Ha, Hb, Hc of the intermediate transfer belt 31 is prevented from coming into contact with and adhering to the leading end 371*a* of the separation claw 371, and the toner is blocked or sometimes prevented from floating, scattering, and adhering to or accumulating on a portion 371*c* (see FIG. 8), on the side where a separated sheet of paper 9 passes through, of the separation claw 371.

Figure 8:
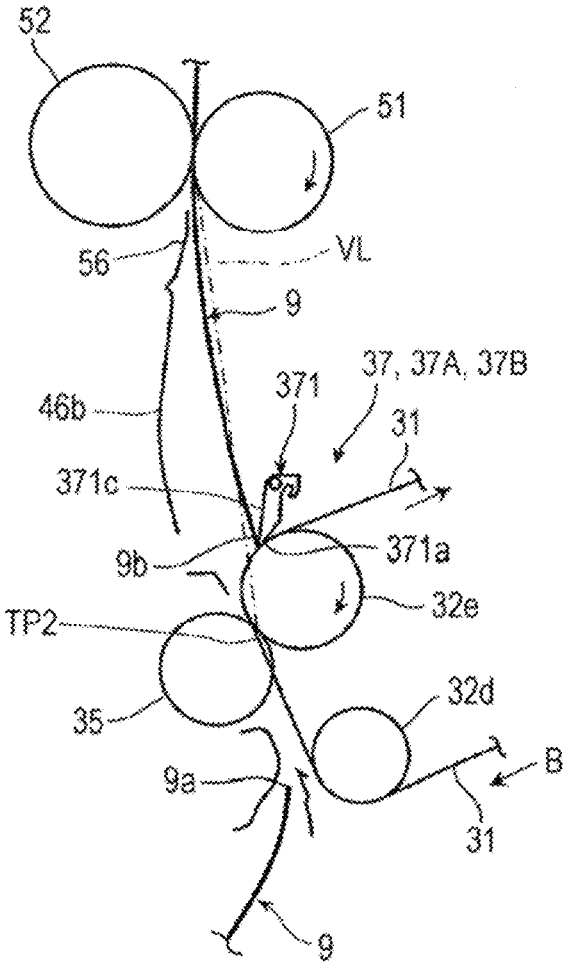
FIG. 8 is a schematic view illustrating the states of the rear end of a sheet of paper and a separation unit.

Consequently, in the image forming apparatus 1, for instance when an image is formed using the sheet of paper 9 of the type represented by thick paper or relatively firm paper, as illustrated in FIG. 8, after a rear end 9*b* of the sheet of paper 9 in the transport direction passes through the second transfer position TP2 (after a sandwich state at the second transfer position TP2 is released), even if the rear end 9*b* may come closer and come into contact with the leading end 371*a* of the separation claw 371, there is no possibility of occurring a problem such that toner adhering to or accumulating on the leading end 371*a* of the separation claw 371 and/or the portion 371*c* on the side where the sheet of paper 9 passes through is transferred to the rear end 9*b*. The symbol 9*a* in FIG. 8 indicates the leading end of the sheet of paper 9 in the transport direction.

Figure 15:
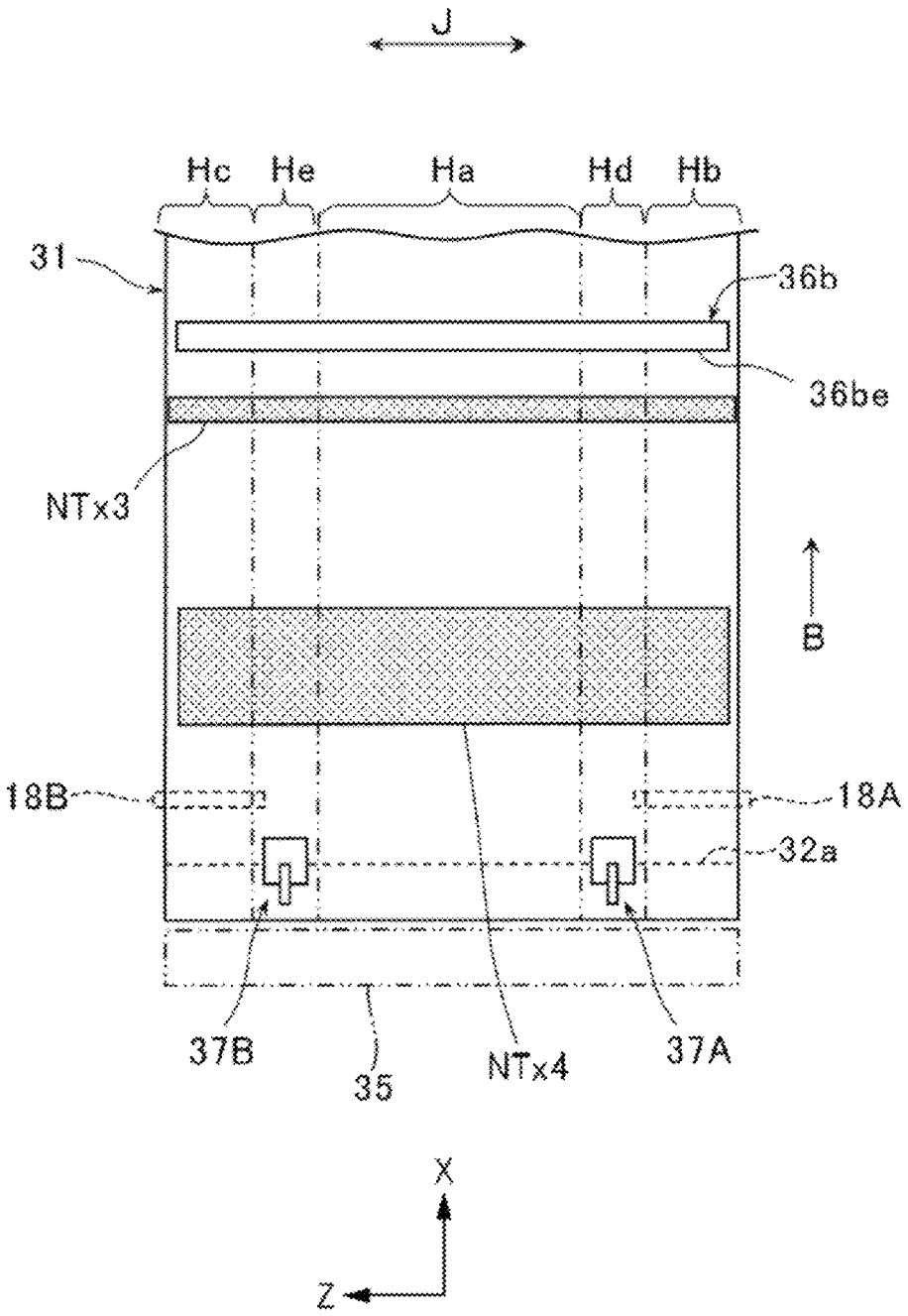
FIG. 15 is a schematic view illustrating a comparative example related to the range where a non-transferred toner image is formed.

In contrast, as illustrated by the toner band image NTx3 and the discharge toner image NTx4 in FIG. 15 as the non-transferred toner image NT, when the non-transferred toner image NT is similarly formed also in the ranges Hd, He of the intermediate transfer belt 31, where the separation devices 37 (37A, 37B) are present, the following problem caused by the separation devices 37 may occur. Here, "similarly formed" refers to formation under the same conditions, such as a concentration for image formation, as those applied to the non-transferred toner image NT formed in the ranges Ha, Hb, Hc.

Figure 16A:
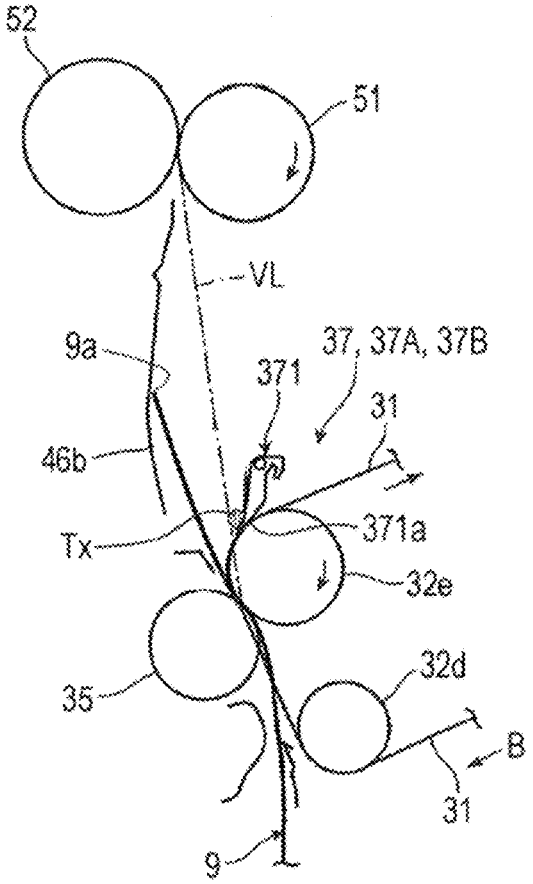
FIG. 16A is a schematic view illustrating an example of state when the non-transferred toner image illustrated in FIG. 15 is formed.

Specifically, in this case, as illustrated in FIG. 16A, toner of part of the toner band image NTx3 and the discharge toner image NTx4 comes into contact with the leading end 371*a* of the separation claw 371 in each separation device 37, and adheres to the leading end 371*a* of the separation claw 371 and/or the portion 371*c* on the side where the sheet of paper 9 passes through, as adherence toner Tx.

Figure 16B:
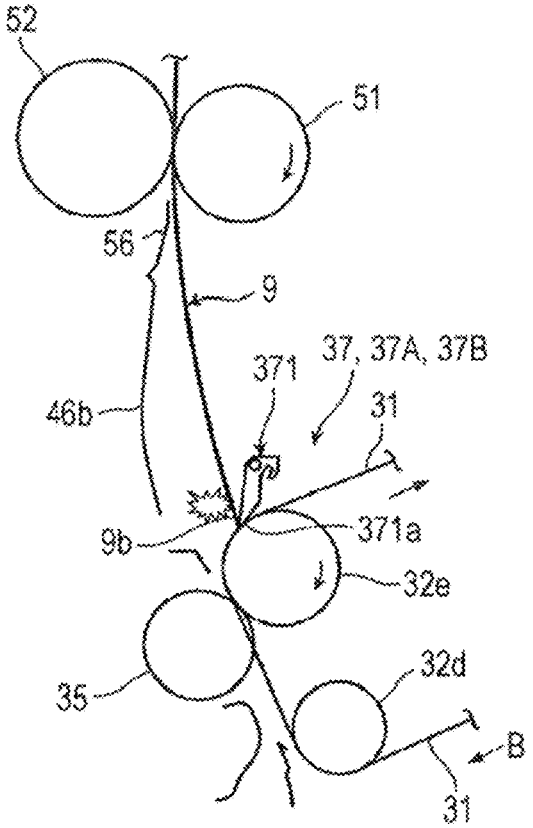
FIG. 16B is a schematic view illustrating an example of state where the rear end of a sheet of paper comes contact with the separation device in the case of FIG. 16A.

Thus, as illustrated in FIG. 16B, when the rear end 9*b* of the sheet of paper 9 at the time of image formation passes through the second transfer position TP2, then comes closer and comes into contact with the leading end 371*a* of the separation claw 371, part or all of the adherence toner Tx adhering to or accumulating on the leading end 371*a* of the separation claw 371 is transferred to the rear end 9*b* of the sheet of paper 9, which becomes dirty, what is called sheet rear end edge stain may occur. Also, since the rear end 9*b* of the sheet of paper 9 comes into contact with the separation claw 371 and applies an impact thereto, part or all of the adherence toner Tx adhering to or accumulating on the leading end 371*a* may float or scatter, and is transferred to the printed surface (front surface or back surface) of the sheet of paper 9, what is called sheet printed surface stain may occur.

Figure 17:
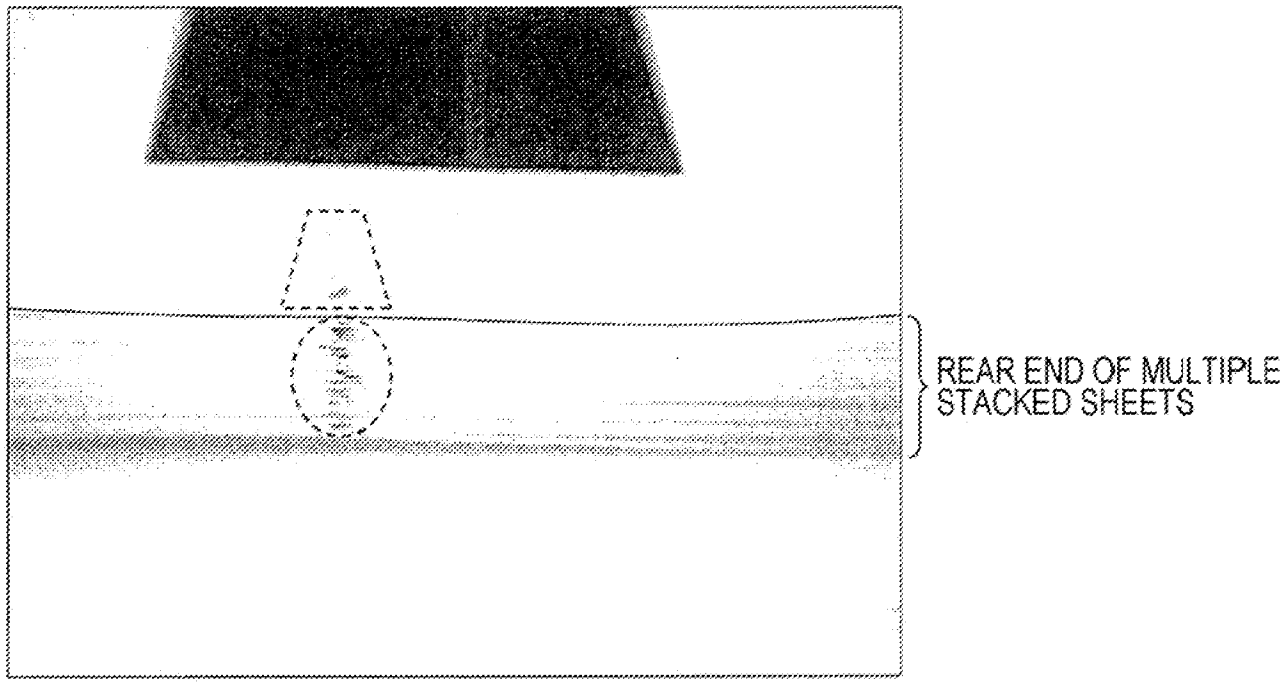
FIG. 17 is a schematic view illustrating an example of state when stain at the rear end of a sheet of paper is noticeable.

Incidentally, as illustrated by an elliptic dotted line frame in FIG. 17, the sheet rear end edge stain becomes noticeable when multiple sheets of paper 9 are stacked. In contrast, as illustrated by a trapezoidal dotted line frame in FIG. 17, the sheet printed surface stain is visually recognized regardless of the stacked state of the sheets of paper 9.

In this regard, with the image forming apparatus 1 according to the first exemplary embodiment, even when the non-transferred toner image NT is formed, the occurrence of the problem (the sheet rear end edge stain, the sheet printed surface stain) caused by the separation devices 37 as illustrated above is reduced.

Incidentally, with the image forming apparatus 1, even when it is difficult to change the position of the separation devices 37 (37A, 37B) for some reasons, the occurrence of the problem caused by the separation devices 37 is reduced by forming the non-transferred toner image NT.

Second Exemplary Embodiment

Figure 9:
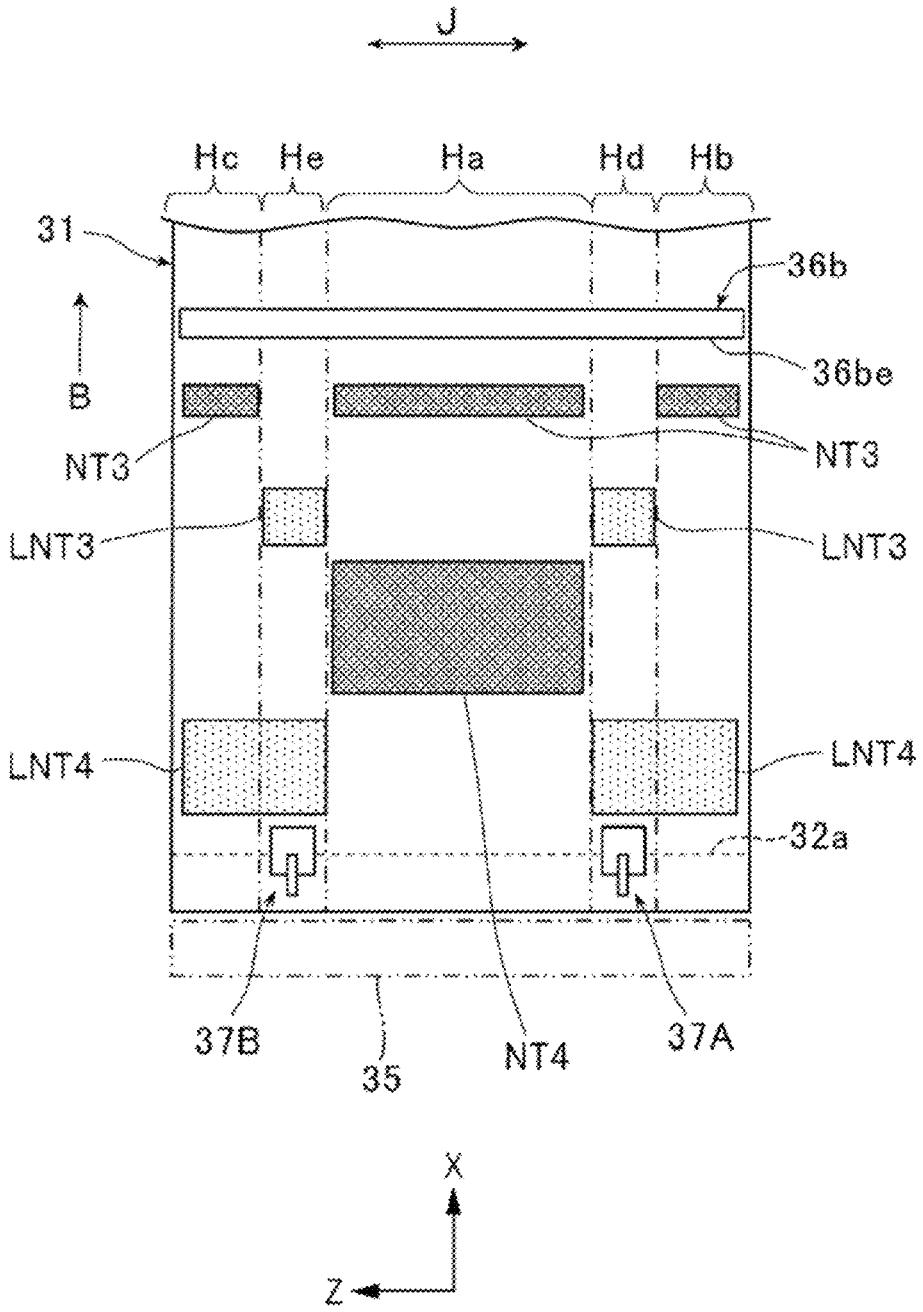
FIG. 9 is a schematic view illustrating part of an image forming apparatus according to a second exemplary embodiment.
Figure 10:
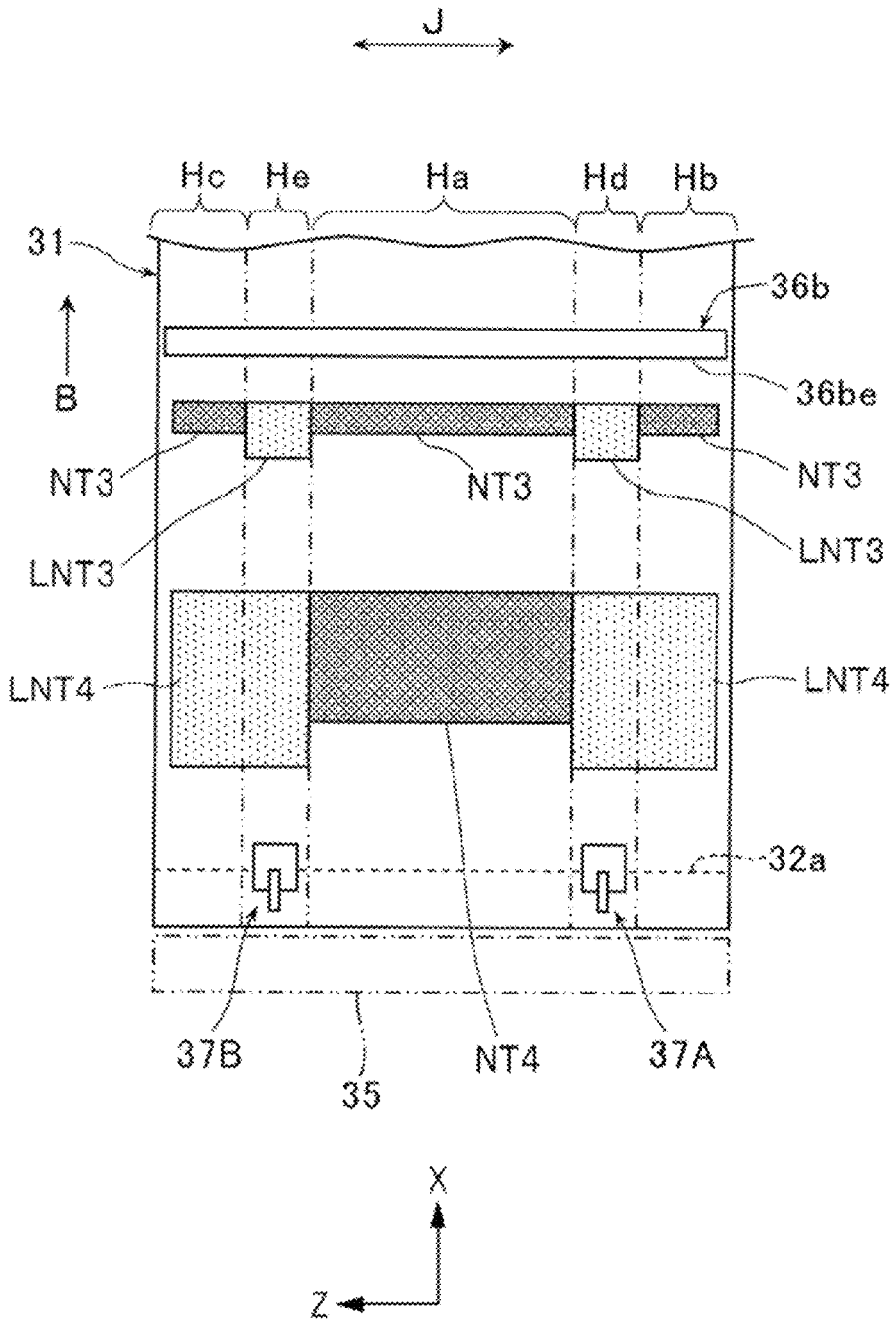
FIG. 10 is a schematic view illustrating another configuration example of times when a low concentration non-transferred toner image is formed in the image forming apparatus of FIG. 9.

FIGS. 9 and 10 illustrate part of an image forming apparatus according to the second exemplary embodiment.

The image forming apparatus according to the second exemplary embodiment has the same configuration as that of the image forming apparatus 1 according to the first exemplary embodiment except that additionally, a low concentration non-transferred toner image LNT is formed as the non-transferred toner image NT in the ranges Hd, He of the intermediate transfer belt 31, where at least the separation devices 37 are present, the low concentration non-transferred toner image LNT being lower in concentration than a normal non-transferred toner image NT which is formed in the ranges Ha, Hb, Hc of the intermediate transfer belt 31, where the separation devices 37 (37A, 37B) are not present.

First, in the image forming apparatus according to the first exemplary embodiment, a normal non-transferred toner image NT is not formed in the ranges Hd, He of the intermediate transfer belt 31, where the separation devices 37 are present, For this reason, the normal non-transferred toner image NT does not arrive at the portion, corresponding to the ranges Hd, He, of the leading end 36*be* of the plate-like cleaning member 36*b* of the belt cleaning device 36, as compared with the portion corresponding to the ranges Ha, Hb, Hc, thus the amount of supplied toner is relatively low accordingly. As a consequence, in (the cleaning member 36*b* of) the belt cleaning device 36, the problem (crying noise and turn-up phenomenon in the cleaning member 36*b*) may occur in the portion corresponding to the ranges Hd, He.

In this regard, with the image forming apparatus according to the second exemplary embodiment, in addition to the normal non-transferred toner image NT, the low concentration non-transferred toner image LNT is formed in the ranges Hd, He of the intermediate transfer belt 31, where at least the separation devices 37 are present, thus as compared with when the low concentration non-transferred toner image LNT is not formed, the occurrence of the problem of the belt cleaning device 36 at the portion of the intermediate transfer belt 31 corresponding to the ranges Hd, He is reduced.

In this process, since the low concentration non-transferred toner image LNT comes into contact with and passes through the separation claw 371 of each separation device 37 (37A, 37B), the concentration of the low concentration non-transferred toner image LNT needs to be set low enough so that toner of part of the low concentration non-transferred toner image LNT does not adhere to the separation claw 371.

Similarly to the case of the non-transferred toner image NT, the low concentration non-transferred toner image LNT starts to be formed by each relevant image forming device 2 (Y, M, C, K) at a predetermined time based on image information which is stored in a relevant component related to the control unit 15 in advance as patterns of positions for image formation. The relevant component includes, for instance, the memory 152 of the central processor 151, the memory of the four color image forming controllers 153, and the memory of the image processor 17.

Next, as conceptually illustrated in FIG. 9, the image forming apparatus according to the second exemplary embodiment forms the low concentration non-transferred toner image LNT at a time different from the time for the non-transferred toner image NT. FIG. 9 illustrates two configuration examples as representatives when the low concentration non-transferred toner image LNT is formed at a different time.

In one configuration example, when the toner band image NT3 is formed as the normal non-transferred toner image NT, a toner band image LNT3 lower in concentration than the toner band image NT3 is formed at a different time.

For the sake of convenience, FIG. 9 illustrates the case where the low concentration toner band image LNT3 is formed successively slightly after the normal toner band image NT3 is formed. However, the "formed at a different time" includes the case where the low concentration toner band image LNT3 is singly formed at a time completely different from the time when the normal toner band image NT3 is formed.

In the other configuration example, when the discharge toner image NT4 is formed as the normal non-transferred toner image NT, a discharge toner image LNT4 lower in concentration than the discharge toner image NT4 is formed at a different time. Due to the situation that the normal non-transferred toner image NT is a pattern which is formed only in the range Ha of the intermediate transfer belt 31, the low concentration discharge toner image LNT4 is formed in an area including the ranges Hb, Hc in addition to the ranges Hd, He.

Similarly to the case of the low concentration toner band image LNT3, for the sake of convenience, FIG. 9 illustrates the case where the low concentration discharge toner image LNT4 is formed successively slightly after the normal discharge toner image NT4 is formed. However, the "formed at a different time" includes the case where the low concentration discharge toner image LNT4 is singly formed at a time completely different from the time when the normal discharge toner image NT4 is formed.

When the low concentration non-transferred toner image LNT is formed at a time different from the time for the normal non-transferred toner image NT in this manner, the time for forming the low concentration non-transferred toner image LNT can be set independently from the time for forming the normal non-transferred toner image NT, as compared with when the low concentration non-transferred toner image LNT and the normal non-transferred toner image NT are formed at the same time. Thus, it is possible to form the low concentration non-transferred toner image LNT only when necessary.

Consequently, in the belt cleaning device 36, the occurrence of the problem at the portion of the cleaning member 36*b* corresponding to the ranges Hd, He of the intermediate transfer belt 31 is reliably reduced. It is to be noted that the low concentration non-transferred toner image LNT formed at a different time may be formed in one of the ranges Ha, Hb, Hc in addition to the ranges Hd, He.

In the image forming apparatus according to the second exemplary embodiment, as conceptually illustrated in FIG. 10, the low concentration non-transferred toner image LNT and the normal non-transferred toner image NT may be formed at the same time. FIG. 10 illustrates two configuration examples as representatives when the two toner images are formed at the same time.

In one configuration example, when the toner band image NT3 is formed as the normal non-transferred toner image NT, the low concentration toner band image LNT3 is formed synchronized with the time when the normal toner band image NT3 is formed. The "formed synchronized with the time" indicates that at least the start time for forming the normal toner band image NT3 is the same as the start time for forming the low concentration toner band image LNT3.

In the other configuration example, when the discharge toner image NT4 is formed as the normal non-transferred toner image NT, the low concentration discharge toner image LNT4 is formed synchronized with the time when the normal discharge toner image NT4 is formed. Similarly to the case of formation time of the low concentration toner band image LNT3, the "formed synchronized with the time" in this case indicates that at least the start time for forming the normal discharge toner image NT4 is the same as the start time for forming the low concentration discharge toner image LNT4.

The normal discharge toner image NT4 illustrated in FIG. 10 is an example where image formation is made in the range Ha excluding the ranges Hb, Hc of the intermediate transfer belt 31. Due to this situation, the low concentration discharge toner image LNT4 is formed not only in the ranges Hd, He of the intermediate transfer belt 31, but also in the ranges Hb, Hc.

When the low concentration non-transferred toner image LNT and the normal non-transferred toner image NT are formed at the same time in this manner, the low concentration non-transferred toner image LNT is reliably formed synchronized with the time when the normal non-transferred toner image NT is formed, as compared with when the low concentration non-transferred toner image LNT and the normal non-transferred toner image NT are formed at different times, and thus the number of singly forming the low concentration non-transferred toner image LNT independently from forming the normal non-transferred toner image NT can be reduced.

In this case also, in the belt cleaning device 36, the occurrence of the problem at the portion of the cleaning member 36*b* corresponding to the ranges Hd, He of the intermediate transfer belt 31 is reliably reduced. In addition, the low concentration non-transferred toner image LNT illustrated in FIG. 10 is also formed in the ranges Hb, Hc of the intermediate transfer belt 31, thus the occurrence of the problem at the portion of the cleaning member 36*b* corresponding to the ranges Hb, Hc of the intermediate transfer belt 31 is also reduced.

It is to be noted that in the image forming apparatus according to the second exemplary embodiment, a configuration in which the low concentration non-transferred toner image LNT and the normal non-transferred toner image NT are formed at different times, and a configuration in which the low concentration non-transferred toner image LNT and the normal non-transferred toner image NT are formed at the same time may be combined.

In addition, as illustrated in FIGS. 9 and 10, the length of the low concentration non-transferred toner image LNT in the rotational direction B is longer than the length of the normal non-transferred toner image NT. Consequently, it is possible to adjust the total amount of toner to be supplied to the portion of the cleaning member 36*b* of belt cleaning device 36, corresponding at least to the ranges Hb, Hc by the formation of the low concentration non-transferred toner image LNT.

However, it is also effective that the above-mentioned length of the low concentration non-transferred toner image LNT is set to be equal to or shorter than the length of the normal non-transferred toner image NT in consideration of the importance of avoiding the adherence of toner to the separation claw 371 of each separation device 37.

Figure 11:
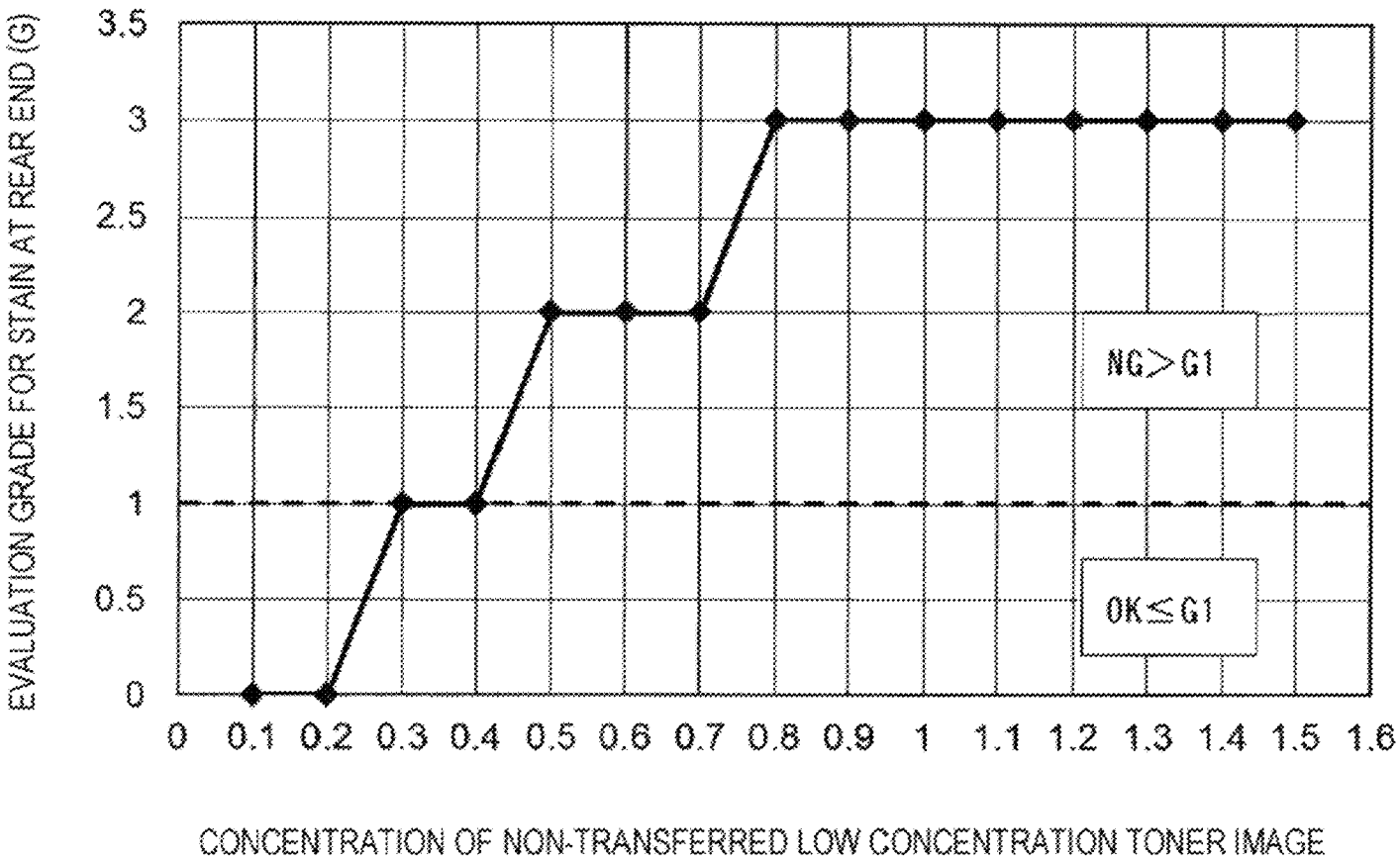
FIG. 11 is a graph illustrating a result of an experiment to investigate the relationship between the concentration of a low concentration non-transferred toner image and occurrence of stain at the rear end of a sheet of paper.

FIG. 11 illustrates a result of an experiment when the relationship between the concentration of the low concentration non-transferred toner image LNT and occurrence of the rear end stain of the sheet of paper 9 is investigated using the image forming apparatus.

In this experiment, an image of black toner with a length of 600 mm is assumed to be formed as the normal non-transferred toner image NT, and a corresponding non-transferred toner image LNT having multiple types of experimental concentrations indicated by plotting in FIG. 11 is formed once in the ranges Hd, He at the same time when the normal non-transferred toner image NT is formed. Subsequently, when the sheet of paper 9 is passed through the second transfer position TP2, it is investigated whether or not toner is adhering to the rear end 9*b* of the sheet of paper 9 and the rear end edge stain has occurred.

In this process, the concentration of the low concentration non-transferred toner image LNT is measured using a measuring instrument (spectral densitometer: X-Rite 962). The non-transferred toner images LNT having various experimental concentrations are formed based on the information on the concentration measured by the measuring instrument.

The occurrence of the rear end edge stain is evaluated by the following criteria, and the result is shown in FIG. 11 as an evaluation grade. The acceptable level is lower than or equal to G1.

Grade G0: no occurrence

Grade G1: occurrence of adherence with a very slight amount which is difficult to visually recognize even when multiple sheets are stacked Grade G2: occurrence of adherence with a slight amount which can be visually recognized when multiple sheets are stacked Grade G3: occurrence of adherence with a level which can be easily recognized by naked eyes From the result shown in FIG. 11, it is seen that when the low concentration non-transferred toner image LNT is formed with a concentration of 0.4 or lower as compared with a concentration of 0.8 or higher, the rear end stain does not occur or an acceptable level is achieved. Incidentally, the normal non-transferred toner image NT at this point is formed with a concentration in a range from 0.8 to 1.3.

With this result, from the point of view of reducing or preventing the occurrence of rear end edge stain, it is preferable that the concentration of the low concentration non-transferred toner image LNT be 50% or lower of the normal non-transferred toner image NT. In addition, from point of view of reliably preventing the occurrence of rear end edge stain, it is more preferable that the concentration of the low concentration non-transferred toner image LNT be 0.2 or lower, and it is sufficient that the concentration of the low concentration non-transferred toner image LNT be equal to or lower than the concentration of the normal non-transferred toner image NT.

Third Exemplary Embodiment

Figure 12:
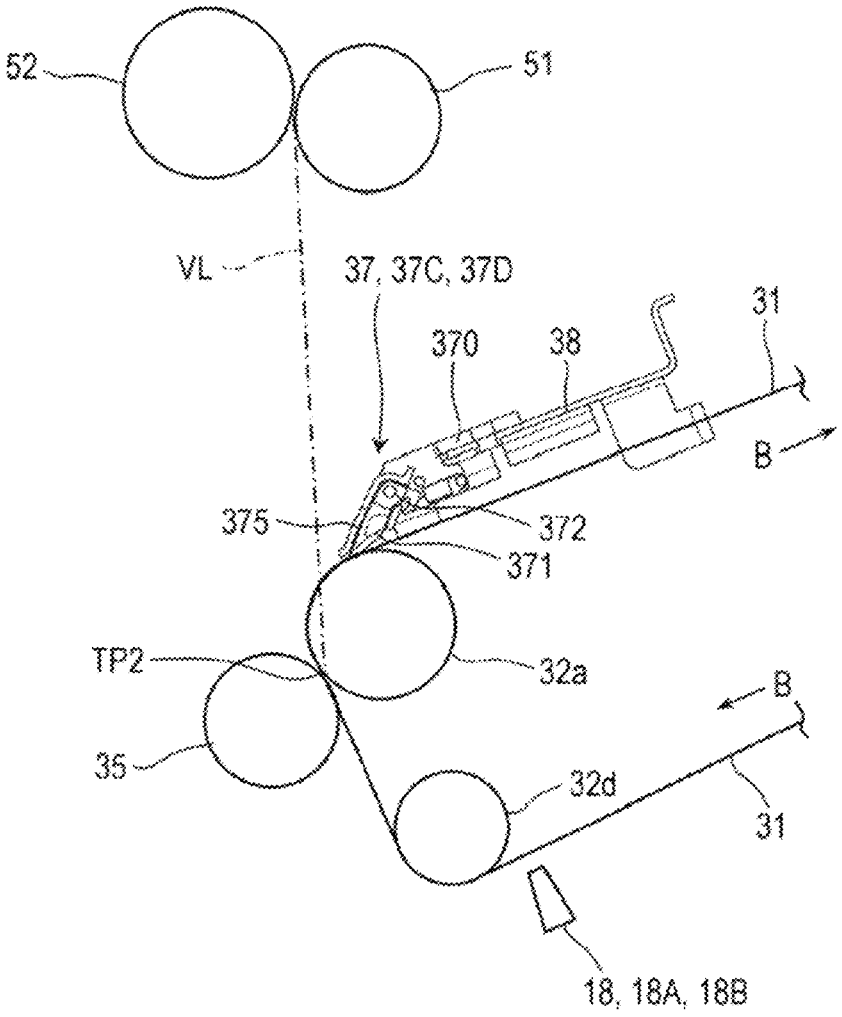
FIG. 12 is a schematic view illustrating part of an image forming apparatus according to a third exemplary embodiment.

FIG. 12 illustrates part of an image forming apparatus according to a third exemplary embodiment.

The image forming apparatus according to the third exemplary embodiment has the same configuration as that of the image forming apparatus according to the first and second exemplary embodiments except that the separation devices 37 (37A, 37B) are changed to separation devices 37 (37C, 37D) having a different configuration.

Figure 13A:
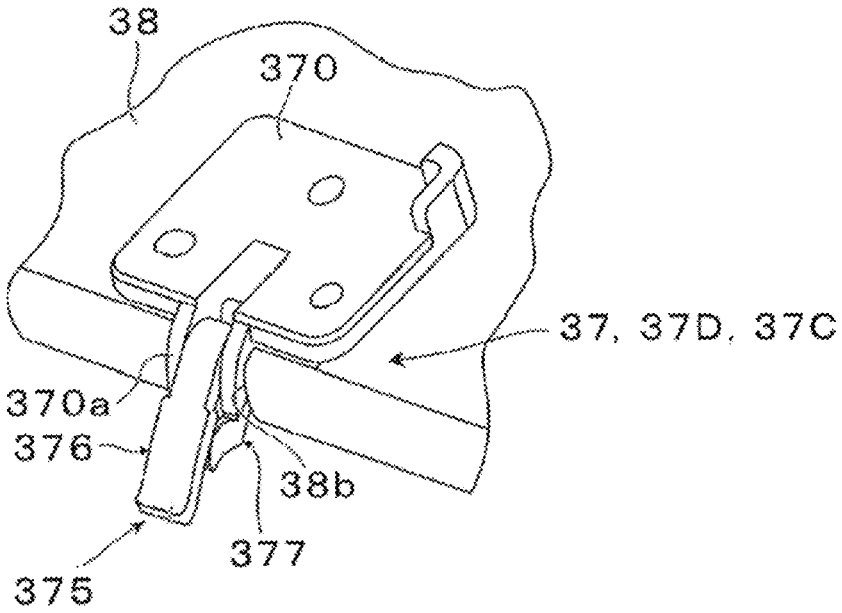
FIG. 13A is a perspective view illustrating a separation device in the image forming apparatus of FIG. 12.
Figure 13B:
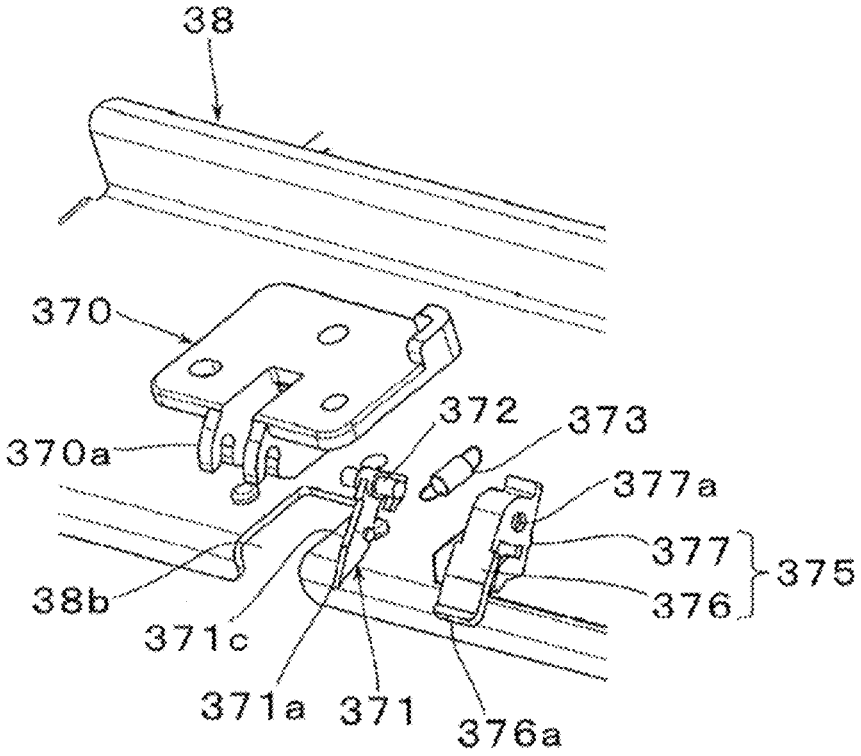
FIG. 13B is a perspective view illustrating a state where the separation device is disassembled.

As illustrated in FIGS. 12, 13A, and 13B, the separation devices 37 (37C, 37D) includes the separation claws 371 of the separation devices 37A, 37B in the first and second exemplary embodiments, and a cover component 375 which is disposed to cover the portion 371*c* of the separation claws 371 on the side where a separated sheet of paper 9 passes through. The symbol 370*a* in FIGS. 13A and 13B indicates a shaft receiver which is provided in the fixing frame 370 to rotatably support a support shaft 372 of the separation claws 371. The symbol 38*b* indicates a mounting notch provided in the mounting plate 38 for allowing the shaft receiver 370*a* of the fixing frame 370 to be fitted in.

As illustrated in FIG. 13B, the cover component 375 includes a plate-like main body section 376 that actually covers the portion 371*c* of the separation claw 371 on the side where the sheet of paper 9 passes through, and a mounting section 377 for mounting the main body section 376 on the fixing frame 370 in combination with the separation claws 371.

Figure 14:
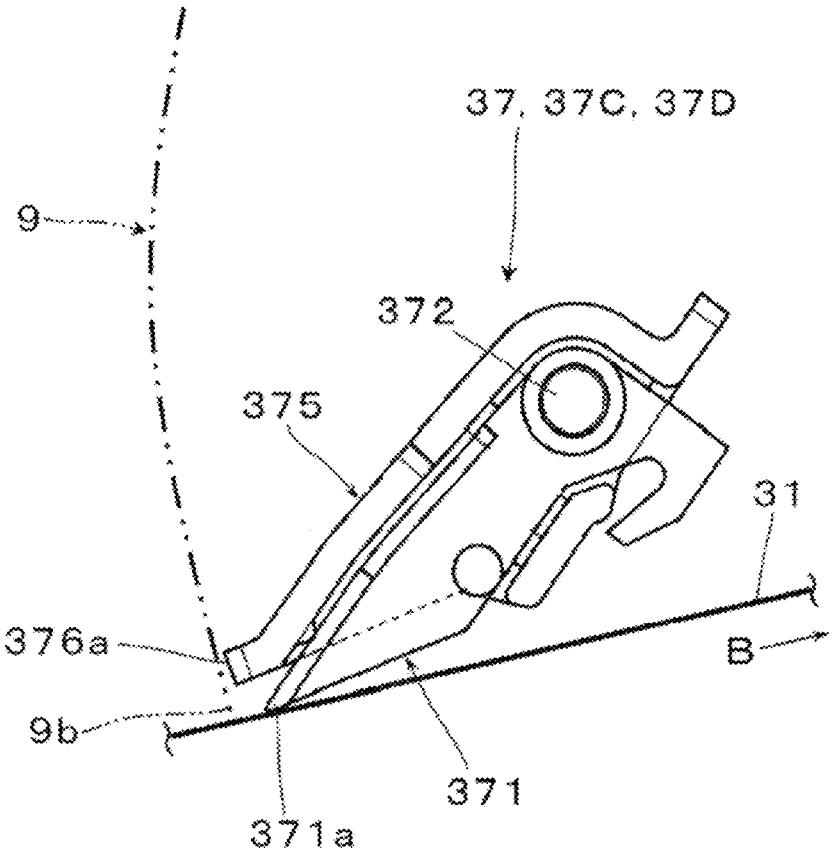
FIG. 14 is a schematic view illustrating the states of the separation device of FIGS. 13A and 13B, and the rear end of a sheet of paper.

The main body section 376 is a substantially rectangular plate-like section with a size covering the entire portion 371*c* of the separation claw 371. As illustrated in FIG. 14, the main body section 376 has a shape bent upward so that a leading end 376*a*, which comes closer to the outer circumferential surface of the intermediate transfer belt 31, is displaced and away from the outer circumferential surface by a desired distance.

The mounting section 377 is a section having a shape which extends from the rear end and one lateral end downward on the rear side of the main body section 376. The mounting section 377 is provided with a shaft receiving hole 377*a* into which one support shaft 372 of the separation claw 371 is fitted and penetrates.

The separation devices 37 (37C, 37D) are assembled in the following manner: the cover component 375 achieves a state of being integrated with the separation claw 371 by fitting one support shaft 372 of the separation claw 371 into the shaft receiving hole 377*a* of the mounting section 377 for penetration, then the support shaft 372 of the separation claw 371 is mounted on the shaft receiver 370*a* of the fixing frame 370, and the elastic member 373 such as a coil spring is attached to the separation claw 371.

In the image forming apparatus according to the third exemplary embodiment, the separation devices 37 (37C, 37D) including the cover component 375 are applied to the intermediate transfer device 3. Thus, at the time of the operation of forming a normal image comprised of a toner image to be transferred to the sheet of paper 9, even when the second transfer is not performed and the intermediate transfer belt 31 with remaining transfer residual toner passes through the separation devices 37C, 37D, or the low concentration non-transferred toner image LNT is formed and passes through the separation devices 37C, 37D, toner is unlikely to adhere to the portion 371*c* of the separation claw 371 on the side where the sheet of paper 9 passes through because the separation claw 371 is covered by the cover component 375.

In the image forming apparatus, as illustrated in FIG. 14, even when the rear end 9*b* of the sheet of paper 9, which has passed through the second transfer position TP2, comes closer to the separation devices 37C, 37D, and passes therethrough in a contact state, the rear end 9*b* of the sheet of paper 9 does not directly come into contact with the leading end 371*a* of the separation claw 371 although the rear end 9*b* may come into contact with the cover component 375.

Even when toner adheres to and accumulates on the leading end 371*a* of the separation claw 371, and the rear end 9*b* of the sheet of paper 9 passes through the separation devices 37C, 37D in a contact state, direct contact of the rear end 9*b* of the sheet of paper 9 with the leading end 371*a* of the separation claw 371 is prevented, and additionally, even when toner accumulating on the portion 371*c* of the separation claw 371 is scattered due to an impact of the contact, movement of the toner is prevented by the cover component 375, and transfer of the toner to the rear end printed surface of the sheet of paper 9 is reduced.

Consequently, rear end stain of the sheet of paper 9 is unlikely to occur in the image forming apparatus.

Thus, in the image forming apparatus, as compared with when the separation device is not configured by the separation claw 371 and the cover component 375, it is possible to prevent toner from adhering to the portion 371*c* of the separation claw 371 on the side where the sheet of paper 9 passes through, and to reduce the occurrence of rear end stain of the sheet of paper 9.

Other Modifications

The disclosure is not limited to the content illustrated in the first to third exemplary embodiments, and includes, for instance, the modifications shown below.

The number of separations devices 37 installed is not limited to two, and may be greater than two or one.

The image forming apparatus 1 is not limited to an intermediate transfer image forming apparatus including the intermediate transfer device 3 illustrated in the first to third exemplary embodiments, and may be a direct transfer image forming apparatus that directly transfers a toner image formed on a photoreceptor such as a photoreceptor drum to a sheet of paper.

The direct transfer image forming apparatus also includes, for instance, a contact separation device that separates a sheet of paper, in the photoreceptor drum 21 which is an example of the image carrying unit, and when a non-transferred toner image NT is formed in the photoreceptor drum 21, the non-transferred toner image NT may be formed in a range of the photoreceptor drum 21 where the separation device is not present. In this image forming apparatus, a low concentration non-transferred toner image LNT may be formed in a range of the photoreceptor drum 21 where at least a separation device is present.

In addition, the disclosure is similarly applicable to a direct transfer image forming apparatus that transports a sheet of paper to a transfer position of a photoreceptor by a transfer transport belt device, and performs transfer.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrying unit that carries an image to be transferred to a sheet which is brought into contact with the image carrying unit and passed through;

a separation unit that separates the sheet from the image carrying unit; and a removal unit that comes into contact with the image carrying unit, and removes toner remaining after the sheet passes the separation unit, wherein a non-transferred toner image that is not transferred to the sheet is formed in a range, where the separation unit is not present, of the image carrying unit, wherein a low concentration non-transferred toner image is formed in a range, where at least the separation unit is present, of the image carrying unit, the low concentration non-transferred toner image being lower in concentration than a normal non-transferred toner image formed in the range where the separation unit is not present.

2. The image forming apparatus according to claim 1, wherein the low concentration non-transferred toner image and the normal non-transferred toner image are formed at different times.

3. The image forming apparatus according to claim 2, wherein the low concentration non-transferred toner image and the normal non-transferred toner image are formed at a same time.

4. The image forming apparatus according to claim 3, wherein the low concentration non-transferred toner image is formed with a low concentration lower than or equal to 50% of a concentration of the normal non-transferred toner image.

5. The image forming apparatus according to claim 4, wherein the separation unit includes a separation claw that separates the sheet, and a cover component that is disposed to cover a portion of the separation claw on a side where the sheet passes.

6. The image forming apparatus according to claim 3, wherein the separation unit includes a separation claw that separates the sheet, and a cover component that is disposed to cover a portion of the separation claw on a side where the sheet passes.

7. The image forming apparatus according to claim 2, wherein the low concentration non-transferred toner image is formed with a low concentration lower than or equal to 50% of a concentration of the normal non-transferred toner image.

8. The image forming apparatus according to claim 7, wherein the separation unit includes a separation claw that separates the sheet, and a cover component that is disposed to cover a portion of the separation claw on a side where the sheet passes.

9. The image forming apparatus according to claim 2, wherein the separation unit includes a separation claw that separates the sheet, and a cover component that is disposed to cover a portion of the separation claw on a side where the sheet passes.

10. The image forming apparatus according to claim 1, wherein the low concentration non-transferred toner image and the normal non-transferred toner image are formed at a same time.

11. The image forming apparatus according to claim 10, wherein the low concentration non-transferred toner image is formed with a low concentration lower than or equal to 50% of a concentration of the normal non-transferred toner image.

12. The image forming apparatus according to claim 11, wherein the separation unit includes a separation claw that separates the sheet, and a cover component that is disposed to cover a portion of the separation claw on a side where the sheet passes.

13. The image forming apparatus according to claim 10, wherein the separation unit includes a separation claw that separates the sheet, and a cover component that is disposed to cover a portion of the separation claw on a side where the sheet passes.

14. The image forming apparatus according to claim 1, wherein the low concentration non-transferred toner image is formed with a low concentration lower than or equal to 50% of a concentration of the normal non-transferred toner image.

15. The image forming apparatus according to claim 14, wherein the separation unit includes a separation claw that separates the sheet, and a cover component that is disposed to cover a portion of the separation claw on a side where the sheet passes.

16. The image forming apparatus according to claim 1, wherein the separation unit includes a separation claw that separates the sheet, and a cover component that is disposed to cover a portion of the separation claw on a side where the sheet passes.

17. The image forming apparatus according to claim 1, wherein the separation unit includes a separation claw that separates the sheet, and a cover component that is disposed to cover a portion of the separation claw on a side where the sheet passes.

18. An image forming apparatus comprising:

image carrying means for carrying an image to be transferred to a sheet which is brought into contact with the image carrying means and passed through;

separation means for separating the sheet from the image carrying means; and removal means, coming into contact with the image carrying means, for removing toner remaining after the sheet passes the separation means, wherein a non-transferred toner image that is not transferred to the sheet is formed in a range, where the separation means is not present, of the image carrying means, and wherein a low concentration non-transferred toner image is formed in a range, where at least the separation means is present, of the image carrying means, the low concentration non-transferred toner image being lower in concentration than a normal non-transferred toner image formed in the range where the separation means is not present.

* * * * *